US011614024B2

(12) United States Patent
Jeong et al.

(10) Patent No.: US 11,614,024 B2
(45) Date of Patent: Mar. 28, 2023

(54) RESERVOIR TANK ASSEMBLY FOR VEHICLE

(71) Applicants: Hyundai Motor Company, Seoul (KR); Kia Corporation, Seoul (KR)

(72) Inventors: Seong Bin Jeong, Gyeonggi-do (KR); Wan Je Cho, Gyeonggi-do (KR); Jae Eun Jeong, Gyeonggi-do (KR); Hyun Jae Lee, Gyeonggi-do (KR); Nam Ho Park, Gyeonggi-do (KR); Tae Hee Kim, Gyeonggi-do (KR); Yeon Ho Kim, Seoul (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 17/714,816

(22) Filed: Apr. 6, 2022

(65) Prior Publication Data

US 2022/0325657 A1 Oct. 13, 2022

(30) Foreign Application Priority Data

Apr. 8, 2021 (KR) ..... 10-2021-0045607
Apr. 1, 2022 (KR) ..... 10-2022-0040928

(51) Int. Cl.
*F01P 11/02* (2006.01)
*F01P 5/10* (2006.01)
*F01P 7/14* (2006.01)

(52) U.S. Cl.
CPC ..... *F01P 11/029* (2013.01); *F01P 5/10* (2013.01); *F01P 7/14* (2013.01); *F01P 2005/105* (2013.01); *F01P 2007/146* (2013.01); *F01P 2050/24* (2013.01)

(58) Field of Classification Search
CPC .... F01P 11/029; F01P 5/10; F01P 7/14; F01P 2005/105; F01P 2007/146; F01P 2050/24; F01P 11/02
See application file for complete search history.

(56) References Cited

U.S. PATENT DOCUMENTS

2020/0408134 A1* 12/2020 Asano ..... F01P 11/08

FOREIGN PATENT DOCUMENTS

KR 2021-0096343 A 8/2021

* cited by examiner

*Primary Examiner* — Jacob M Amick
(74) *Attorney, Agent, or Firm* — Fox Rothschild LLP

(57) ABSTRACT

Disclosed herein is an integrated reservoir tank assembly for a vehicle. The integrated reservoir tank assembly for a vehicle includes an integrated reservoir tank in which an inner space is partitioned into a first chamber configured to store cooling water of a first cooling circuit and a second chamber configured to store cooling water of a second cooling circuit by a partition wall; a first electric water pump integrally coupled to the first chamber of the integrated reservoir tank and configured to transmit the cooling water stored in the first chamber along a cooling water line of the first cooling circuit; and a second electric water pump integrally coupled to the second chamber of the integrated reservoir tank and configured to transmit the cooling water stored in the second chamber along a cooling water line of the second cooling circuit.

21 Claims, 13 Drawing Sheets

RESERVOIR TANK ASSEMBLY FOR VEHICLE

CROSS-REFERENCE TO RELATED APPLICATION

This application claims under 35 U.S.C. § 119(a) the benefit of priority to Korean Patent Applications Nos. 10-2021-0045607 filed on Apr. 8, 2021 and 10-2022-0040928 filed on Apr. 1, 2022, the entire contents of which are incorporated herein by reference.

BACKGROUND

(a) Technical Field

The present disclosure relates to a reservoir tank assembly for a vehicle, and more particularly, to an integrated reservoir tank assembly for a vehicle, in which in certain preferred aspects the number of parts is capable of being reduced, reduction in material cost and weight is capable of being achieved, an installation space is easily secured and an arrangement is easily achieved, and/or a problem of a disadvantageous layout of a space in a vehicle and a problem of degradation in productivity are capable of being solved.

(b) Background Art

Recently, as the interest in energy efficiency and environmental pollution problems is growing, the development of eco-friendly vehicles which are substantially replaceable with internal combustion engine vehicles is being carried out. The eco-friendly vehicles may be classified into electric vehicles (FCEV and BEV) driven using fuel cells or batteries as power sources, and hybrid vehicles (HEV and PHEV) driven using engines and motors as driving sources. All of these eco-friendly vehicles (xEV) have in common in that eco-friendly vehicles (xEV) are motor-driven vehicles and electrified vehicles which travel by driving motors with electric power charged in batteries In addition, eco-friendly vehicles including electric vehicles are equipped with thermal management systems so as to perform thermal management on entireties of the eco-friendly vehicles. The thermal management system may be defined as a system in a broad sense including an air conditioner of a HVAC, a cooling system using cooling water or refrigerant for thermal management and cooling of a power system, and a heat pump system.

Here, the cooling system includes components capable of managing heat of the power system by circulating the cooling water or the refrigerant to cool or heat components of the power system. In addition, the heat pump system may be used as an auxiliary heating device separate from an electric heater (e.g., positive temperature coefficient (PTC) heater), which is a main heating device, and is a system configured to recover waste heat from power electronic (PE) parts or batteries and use the waste heat for heating.

A known water cooling system includes a cooling circuit for cooling parts using cooling water, and the cooling circuit includes a reservoir tank which stores cooling water, an electric water pump for transmitting the cooling water, a radiator and a cooling fan for dissipating heat of the cooling water, a chiller for cooling the cooling water, a cooling water heater for heating the cooling water, valves for controlling a flow of the cooling water, and a type of hose such as a cooling water line which connects the devices to the components. In addition, the water cooling system includes a controller for controlling the devices of the cooling circuit to control circulation and a flow of the cooling water and control a temperature of the cooling water in the cooling circuit.

The chiller cools the cooling water using the refrigerant of the air conditioner system, is a heat exchanger for transferring heat of the cooling water to the refrigerant through heat exchange between the cooling water and the refrigerant in a state in which heat of a component, which is a cooling target, is transferred to the cooling water and a cooler for cooling the cooling water through the refrigerant to ultimately allow the parts to be cooled due to the cooling water.

The cooling system of an electric vehicle controls temperature of the PE components and the battery by circulating the cooling water along a cooling water passage of the PE components for driving the vehicle and a cooling water passage of the battery which supplies operating power to the PE components. In addition, the cooling system may be configured to separately cool the PE components and the battery or integrally cool the PE components and the battery. To this end, the cooling system may control a flow direction of the cooling water by controlling an operation of a three-way valve and the like.

Meanwhile, in the vehicle equipped with the water cooling system, a reservoir tank is to store the cooling water, performs a damping function for a working fluid (the cooling water), continuously discharges air bubbles generated in the cooling water passage, and allows the cooling water to be supplemented, and prevents a negative pressure from occurring in a cooling water system.

In a typical water cooling system, when ranges of operating temperatures of components which are cooling targets are different and thus two or more cooling circuits need to be configured independently, one reservoir tank is used for each cooling circuit. That is, since temperature conditions of the cooling water required in the two or more cooling circuits are different from each other, the reservoir tank should also be separately provided for each cooling circuit.

For example, in the case of a hybrid vehicle, a cooling circuit for electrical and electronic parts and a cooling circuit for an engine may be independently configured, and in the case of a water-cooling type turbocharger vehicle, a low temperature cooling circuit for a turbocharger and a cooling circuit for an engine may be independently configured, and in the case of an electric vehicle, a cooling circuit for a battery and a cooling circuit for PE components (a motor end the like) may be independently configured.

Thus, the hybrid vehicle is equipped with one reservoir tank for electrical and electronic parts used in the cooling circuit for the electrical and electronic parts, and one reservoir tank for the engine used in the cooling circuit for the engine. Since only one reservoir tank of the cooling circuit for the engine is required in a general internal combustion engine vehicle, in the case of the hybrid vehicle or the electric vehicle, the number of reservoir tanks is larger when compared to the general internal combustion engine vehicle.

Consequently, in a vehicle including a plurality of cooling circuits, when compared to the general internal combustion engine vehicle, the number of reservoir tanks is inevitably increased and an amount of use of a cooling water hose is inevitably increased, and there is a problem in that the number of parts, a material cost, and weight are increased.

In addition, since the two reservoir tanks should be disposed and mounted in a narrow space (corresponding to an engine room of the existing internal combustion engine vehicle) in the vehicle, it is difficult to secure an installation space and there is a disadvantage in terms of the layout of a space in the vehicle due to the mounting of the two reservoir tanks. In addition, when cooling water is injected, since the cooling water should be injected into each of the two reservoir tanks, there is a problem in that productivity is degraded due to an increase in cycle time for cooling water injection.

SUMMARY OF THE DISCLOSURE

The present disclosure has been made in an effort to solve the above-described problems associated with prior art.

In one aspect, the present disclosure provides an integrated reservoir tank assembly for a vehicle, in which the number of parts is capable of being reduced, reduction in material cost and weight is capable of being achieved, an installation space is easily secured and an arrangement is easily achieved, and/or a problem of a disadvantageous layout of a space in a vehicle and a problem of degradation in productivity are capable of being solved.

Objectives of the present disclosure are not limited to the above-described objectives, and other objectives of the present disclosure, which are not mentioned, can be understood by the following description and also will be apparently understood through embodiments of the present disclosure. Further, the objectives of the present disclosure can be implemented by means described in the appended claims and a combination thereof.

In an exemplary embodiment, the present disclosure provides a reservoir tank assembly for a vehicle, which includes an integrated reservoir tank in which an inner space is partitioned into a first chamber configured to store cooling water of a first cooling circuit and a second chamber configured to store cooling water of a second cooling circuit by a partition wall; a first electric water pump integrally coupled to the first chamber of the integrated reservoir tank and configured to transmit the cooling water stored in the first chamber along a cooling water line of the first cooling circuit; and a second electric water pump integrally coupled to the second chamber of the integrated reservoir tank and configured to transmit the cooling water stored in the second chamber along a cooling water line of the second cooling circuit.

As referred to herein, in certain aspects, the term "integrated" can designate a unitary or singular structure may suitably comprise multiple (e.g. 2, 3, 4 or more, and particularly 2) compartments or sections where adjacent sections may share a common wall or otherwise provide an integrated structure, and preferably where separate compartments or sections can hold separate volumes of fluid. The term "unitary" as well as "integrated" can mean in at least certain aspects that the structure (e.g. reservoir tank) is a continuous piece.

In additional aspects, a vehicle is provided that comprises one or more reservoir tank assemblies as disclosed herein. In certain aspects a vehicle may comprise 2 or more reservoir tank assemblies as disclosed herein. In certain aspects, the vehicle may be an electric-powered vehicle. In certain aspects, the vehicle may be a hybrid vehicle.

Other aspects and preferred embodiments of the present disclosure are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The above and other features of the present disclosure are discussed infra.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present disclosure, and wherein.

Figure 1:
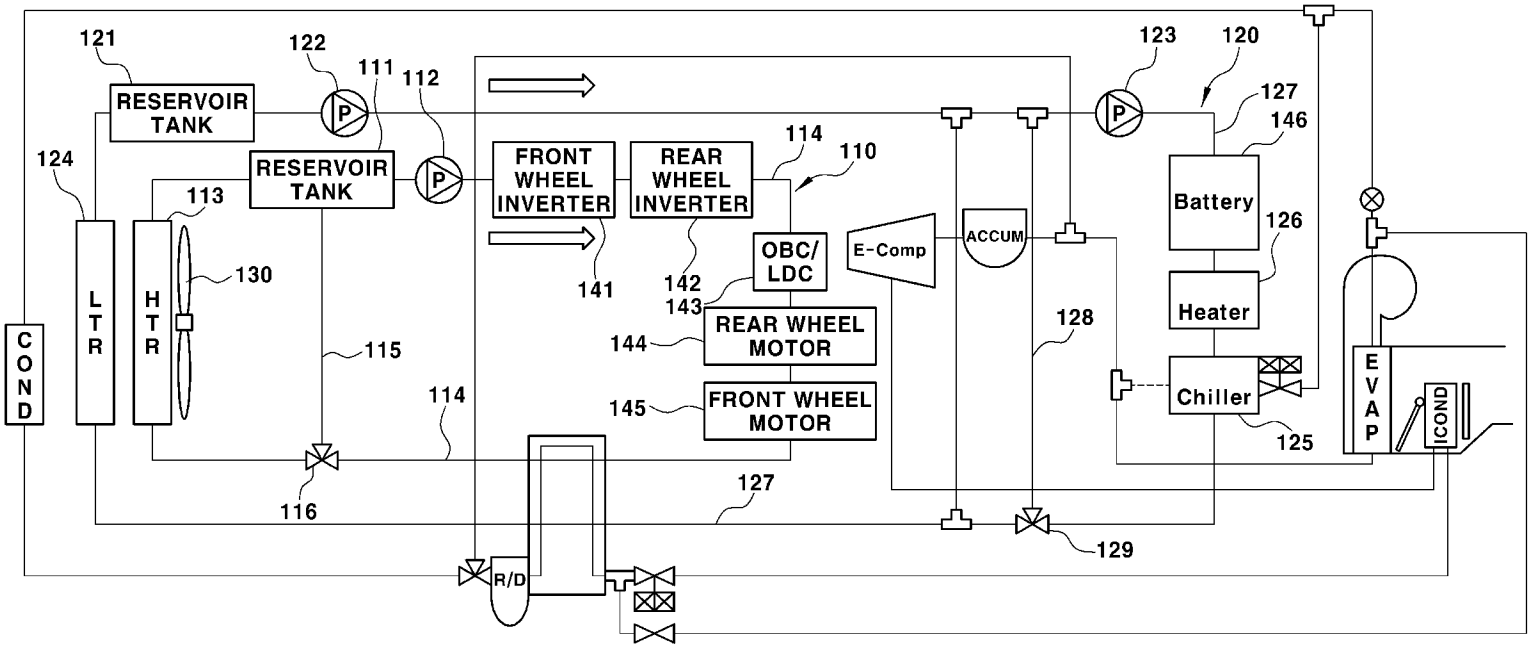
FIG. 1 is a block diagram illustrating a thermal management system for an electric vehicle according to the related art.

It should be understood that the appended drawings are not necessarily to scale, presenting a somewhat simplified representation of various preferred features illustrative of the basic principles of the present disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawing.

DETAILED DESCRIPTION

Specific structures or functional descriptions presented in the embodiments of the present disclosure are merely exemplified for the purpose of describing the embodiments according to the concept of the present disclosure, and the embodiments according to the concept of the present disclosure may be implemented in various forms. In addition, the embodiments are not to be taken in a sense which limits the present disclosure to the specific embodiments, and should be construed to include modifications, equivalents, or substitutes within the spirit and technical scope of the present disclosure.

Meanwhile, the terms first, second, and/or the like in the present disclosure may be used to describe various components, but the components are not limited by these terms. These terms may be used only for the purpose of distinguishing one component from another component, and, for example, a first component may be referred to as a second element, and similarly, the second component may also be referred to as the first component without departing from the scope of the present disclosure.

When a component is referred to as being "connected" or "coupled" to another component, it may be directly connected or coupled to another component, but it should be understood that sill another component may be present between the component and another component. On the contrary, when a component is referred to as being "directly connected to," or "directly in contact with" another component, it should be understood that still another component may not be present between the component and another component. Other expressions describing the relationship between components, that is, "between" and "immediately between," or "adjacent to" and "directly adjacent to" should also be construed as described above.

Throughout the present specification, the same reference numerals indicate the same components. Terms used herein are for the purpose of describing the embodiments and are not intended to limit the present disclosure. In the present specification, the singular forms include the plural forms unless the context clearly dictates otherwise. It is noted that the terms "comprises" and/or "comprising" used herein do not exclude the presence or addition of one or more other components, steps, operations, and/or elements in addition to stated components, steps, operations, and/or elements.

The present disclosure relates to an integrated reservoir tank assembly for a vehicle, in which the number of parts used in a water cooling system is capable of being reduced, reduction in material cost and weight is capable of being achieved, an installation space is easily secured and an arrangement is easily achieved, and a problem of a disadvantageous layout of a space in a vehicle and a problem of degradation in productivity are capable of being solved.

The integrated reservoir tank assembly according to the present disclosure may be applied to a water cooling system having a plurality of cooling circuits, specifically, two cooling circuits. In addition, in the integrated reservoir tank assembly according to the present disclosure, an inner space of a reservoir tank is divided into two chambers so as to allow cooling water used in the two cooling circuits to be stored therein, and an entire configuration of the integrated reservoir tank assembly including the two chambers is integrated.

In a conventional water cooling system, a cooling water line is applied to each of the two cooling circuits, and two reservoir tanks for storing the cooling water are also used. FIG. 1 is a circuit diagram illustrating a configuration of a thermal management system for an electric vehicle according to the related art. In FIG. 1, a reference numeral 110 denotes a first cooling circuit, and a reference numeral 120 denotes a second cooling circuit.

As shown in the drawing, the thermal management system of the electric vehicle includes a water cooling system for cooling power electronic (PE) parts 141 to 145 and a battery 146. Here, the water cooling system includes the first cooling circuit 110 for cooling the PE parts 141 to 145 for vehicle driving in the electric vehicle, and the second cooling circuit 120 for thermal management and cooling for the battery 146.

A reservoir tank assembly (not shown in FIG. 1) according to the present disclosure may be applied to the water cooling system for an electric vehicle as shown in FIG. 1. In the water cooling system according to the related art, two reservoir tanks 111 and 121 separated into separate items are used instead of the integrated reservoir tank assembly according to the present disclosure, and electric water pumps (EWPs) 112 and 122 in the cooling circuits 110 and 120 are also formed in a structure separated from the reservoir tanks 111 and 121.

Referring to FIG. 1, each of the cooling circuits 110 and 120) of the water cooling system may be formed to be capable of circulating cooling water to cool or heat power the PE parts 141 to 145 and the battery 146 to manage heat in a power system and may include a component for cooling or heating the cooling water. In this case, the water cooling system may be a parallel-type separation cooling system in which two radiators 113 and 124 are disposed in a front end portion of the vehicle and parallel cooling water lines 114 and 127 circulating in the radiators 113 and 124 are formed so that the PE parts 141 to 145 and the battery 146 may be separately cooled.

Among the target cooling components, the PE parts 141 to 145 may include a front wheel motor 145 and a rear wheel motor 144 which are driving sources for driving the vehicle, a front wheel inverter 141 and a rear wheel inverter 142 for driving and controlling the front wheel motor 145 and the rear wheel motor 144, and an on-board charger (OBC) and a low voltage direct-current (DC-DC) converter (LDC) 143 for charging the battery 146.

Referring to FIG. 1, it can be seen that the cooling water lines 114 and 127 are connected to two radiators, that is, a first radiator (high temperature radiator (HTR)) 113 and a second radiator (low temperature radiator (LTR)) 124, respectively. The first radiator 113 and the second radiator 124 discharge heat from the cooling water circulating in each of the cooling water lines 114 and 127 and cool the cooling water due to heat exchange between outdoor air sucked by a cooling fan 130 and the cooling water in each of the radiators 113 and 124.

As described above, in the parallel-type separation cooling system having the two cooling circuits, the first radiator 113 of the two radiators is an HTR which passes relatively high-temperature cooling water to dissipate heat and cool according to an operating temperature (a cooling water temperature). In addition, the second radiator 124 is an LTR which passes relatively low temperature cooling water to dissipate heat and cool. Here, the first radiator 113 is a radiator of the first cooling circuit 110 for cooling the PE parts 141 to 145, and the second radiator 124 is a radiator of the second cooling circuit 120 for cooling the battery 146.

In addition, unlike the cooling system according to the related art shown in FIG. 1, when an integrated reservoir tank assembly according to the present disclosure is applied to the cooling system, the cooling water lines 114 and 127 used in the two cooling circuits 110 and 120 are connected to the integrated reservoir tank assembly. That is, in the first cooling circuit 110 of the cooling system, the first cooling water line 114 is connected to allow the cooling water to circulate between the PE components such as the first radiator 113, the reservoir tank assembly (not shown in FIG. 1), the front wheel inverter 141, the rear wheel inverter 142, the OBC and LDC 143, the rear wheel motor 144, and the front wheel motor 145.

In this case, in the first cooling water line 114, a first electric water pump 112 is installed so as to pressure transfer the cooling water for circulation of the cooling water, a first bypass line 115 is installed so as to connect between the first cooling water lines 114 of a front end and a rear end of the first radiator 113, and a first valve 116 is installed so as to selectively flow the cooling water to the first radiator 113.

Here, the first cooling water line 114 at a position of the front end of the first radiator 113 refers to a first cooling water line connected to a cooling water inlet of the first radiator 113, and the position of the front end of the first radiator 113 refers to an upstream position of the first radiator 113 based on a flow direction of the cooling water. Similarly, the first cooling water line 114 at a position of the rear end of the first radiator 113 refers to a first cooling water line connected to a cooling water outlet of the first radiator 113, and the position of the rear end of the first radiator 113 refers to a downstream position of the first radiator 113 based on the flow direction of the cooling water.

In addition, in the second cooling circuit 120 of the cooling system, a second cooling water line 127 is connected to circulate the cooling water between the second radiator 124, the reservoir tank 121, the battery 146, a cooling water heater 126, and a chiller 125. In the second cooling water line 127, a second electric water pump 122 and a third electric water pump 123 are installed so as to pressure transfer the cooling water for circulation of the cooling water, a second bypass line 128 is installed so as to connect between the second cooling water line 127 of a front end and a rear end of the second radiator 124, and a second valve 129 is installed so as to selectively flow the cooling water to the second radiator 124. Consequently, the second cooling circuit 120 is configured to cool the battery 146 by circulating the cooling water through the second cooling water line 127.

Meanwhile, the two cooling circuits 110 and 120 have different management temperatures for target cooling components. For example, in the case of the first cooling circuit 110 in which the high-temperature radiator (first radiator) 113 is used, a management temperature may be 40° C., and in the case of the second cooling circuit 120 in which the low-temperature radiator (second radiator) 124 is used, the management temperature may be 65° C.

Accordingly, as shown in FIG. 1, in the thermal management system according to the related art, the two radiators 113 and 124, the two reservoir tanks 111 and 121 which are separated from each other, and the two electric pumps 112 and 122 which are separated from the two reservoir tanks 111 and 121 are used. Thus, since the thermal management system according to the related art has a large number of parts, and the water pumps 112 and 122 are immediately disposed on the rear ends of the reservoir tanks 111 and 121 (at downstream based on the flow direction of the cooling water), the layout around the reservoir tanks 111 and 121 is very complicated due to connection hoses. In addition, in the design of an electric vehicle, in particular, as a vehicle hood line is gradually lowered, it is impossible to satisfy pedestrian regulations with a separated-type reservoir tank according to the related art (the two reservoir tanks are applied separately).

Therefore, disclosed is an integrated reservoir tank assembly capable of reducing the number of parts, a weight, and a production cost by integrating the reservoir tank 111 and the first electric water pump 112 of the first cooling circuit 110 for cooling the PE parts 141 to 145, the second reservoir tank 121 and the second electric water pump 122 of the second cooling circuit 120 for cooling the battery 146, and the first valve 116.

Hereinafter, exemplary embodiments of the present disclosure will be described in detail with reference to the accompanying drawings.

Figure 2:
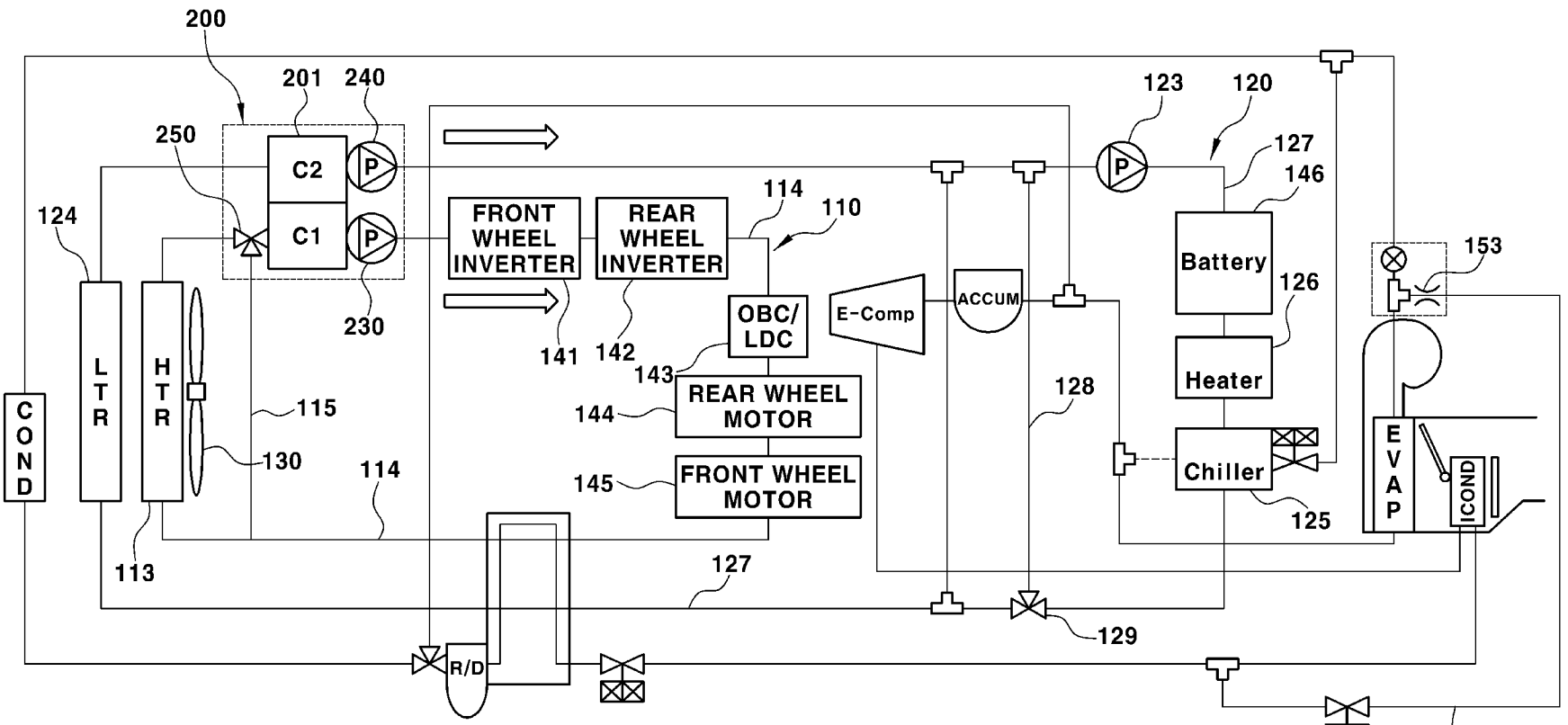
FIG. 2 is a block diagram illustrating a thermal management system for an electric vehicle to which an integrated reservoir tank assembly is applied according to an embodiment of the present disclosure.
Figure 3:
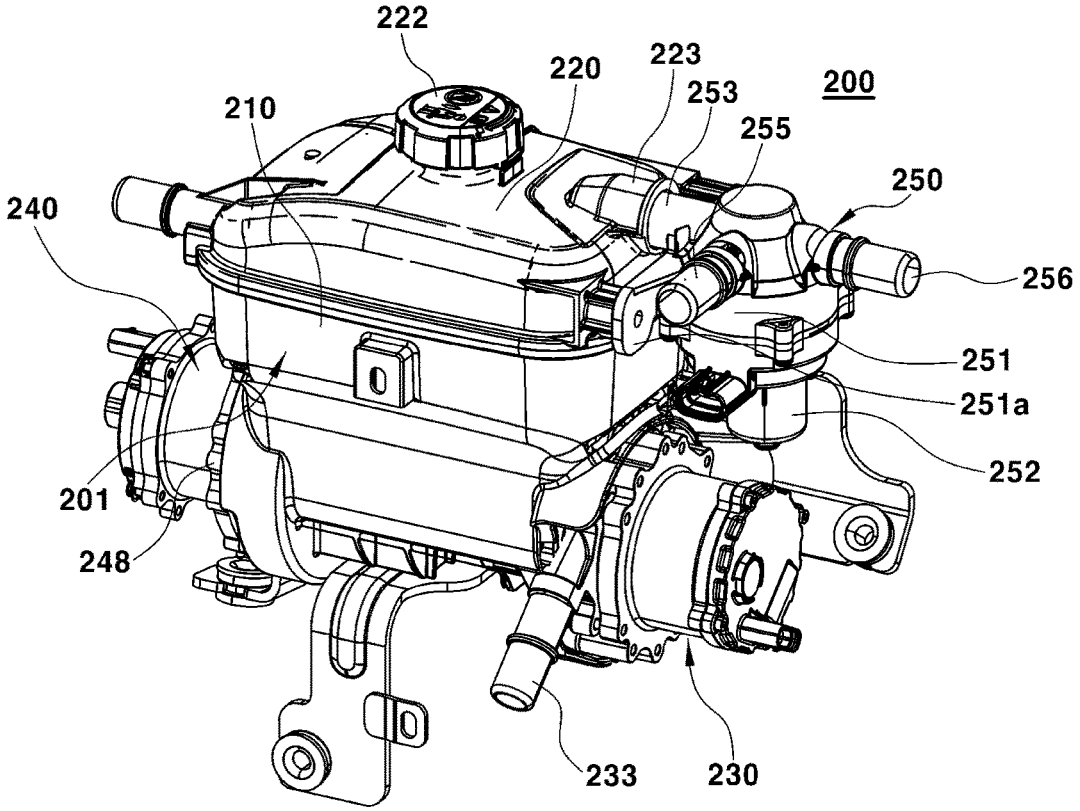
FIG. 3 is a perspective view illustrating the integrated reservoir tank assembly according to the embodiment of the present disclosure.

FIG. 2 is a block diagram illustrating a thermal management system for an electric vehicle to which a reservoir tank assembly 200 is applied according to an embodiment of the present disclosure, and FIG. 3 is a perspective view illustrating the reservoir tank assembly 200 according to the embodiment of the present disclosure; An integrated reservoir tank assembly 200 according to an embodiment of the present disclosure may be applied not only to the water cooling system of the thermal management system illustrated in FIG. 1, but also to a water cooling system of a thermal management system illustrated in FIG. 2.

In the thermal management system of FIG. 2, when compared to the thermal management system of FIG. 1, there is a difference in that a branch position of a dehumidification line 151 is changed, and an expansion valve 152 for dehumidification and an orifice part 153 are additionally installed. Referring to FIG. 2, it can be seen that the reservoir tank assembly 200 according to the embodiment of the present invention is installed at a position on rear ends of the first radiator 113 and the second radiator 124 (a downstream based on a flow direction of cooling water). As shown in FIGS. 2 and 3, the reservoir tank assembly 200 according to the embodiment of the present invention includes an integrated reservoir tank 201. Here, the integrated reservoir tank 201 includes a tank main body 210 in which an inner space is divided into a first chamber C1 and a second chamber C2 which are capable of storing cooling water of the first cooling circuit 110 and cooling water of the second cooling circuit 120, respectively and of which an upper portion is open, and a cover 220 assembled to seal the upper portion of the tank main body 210. As described above, the reservoir tank assembly 200 according to the embodiment of the present invention has a configuration in which one cover 220 is assembled with one tank main body 210 having the two chambers C1 and C2 used as cooling water storage spaces.

In addition, the reservoir tank assembly 200 according to the embodiment of the present disclosure further includes a first electric water pump 230 and a second electric water pump 240 which are integrally coupled to the two chambers C1 and C2 of the tank main body 210, respectively, and a three-way valve (first valve) 250 coupled to the integrated reservoir tank 201 and configured to control a flow direction of the cooling water to allow the cooling water to flow to a selected one of the first bypass line 115 of the first cooling circuit 110 and the first cooling water line 114 of the first radiator 113.

In the thermal management system of FIG. 2, the first cooling circuit 110 and the configuration thereof and the second cooling circuit 120 and the configuration thereof are not different when compared to the thermal management system of FIG. 1, except for an application of the integrated reservoir tank assembly 200. Since the configurations of the first cooling circuit 110 and the second cooling circuit 120 have already been described with reference to FIG. 1, a description of the same configuration as that of the thermal management system of FIG. 1 in the thermal management system of FIG. 2 will be omitted herein.

In the thermal management system of FIG. 1, the first reservoir tank 111 of the first cooling circuit 110 and the second reservoir tank 121 of the second cooling circuit 120 are replaced with the integrated reservoir tank 201 of the integrated reservoir tank assembly 200 shown in FIG. 2. In addition, as shown in FIG. 2, the reservoir tank assembly 200 according to the embodiment of the present disclosure has a difference in a configuration in which the first electric water pump 230 of the first cooling circuit 110, the second electric water pump 240 of the second cooling circuit 120, and a three-way valve which is the first valve 250 of the first cooling circuit 110 are directly coupled to the integrated reservoir tank 201.

As described above, the integrated reservoir tank 201 includes one tank main body 210 and one cover 220. The tank main body 210 has the first chamber C1 and the second chamber C2 which are inner storage spaces for storing the cooling water (see FIGS. 2 and 5), the first chamber C1 is a chamber in which the cooling water of the first cooling circuit 110 is stored, and the second chamber C2 is a chamber in which the cooling water of the second cooling circuit 120 is stored. Here, the first cooling circuit 110 is to cool the PE components such as motors 144 and 145, inverters 141 and 142, and the OBC and LDC 143, and the second cooling circuit 120 is to cool the battery 146 (see FIG. 2).

In FIG. 3, a right portion of the tank main body 210 is a portion having the first chamber C1 therein as a cooling water storage space, and a left portion of the tank main body 210 is a portion having the second chamber C2 therein as a cooling water storage space. In addition, the first electric water pump 230 for circulating the cooling water of the first cooling circuit 110 is integrally coupled to a portion of one side of the tank main body 210 in which the first chamber C1 is located, and the second electric water pump 240 for circulating the cooling water of the second cooling circuit 120 is integrally coupled to a portion of the other side of the tank main body 210 in which the second chamber C2 is located.

In addition, the three-way valve (first valve) 250 of the first cooling circuit 110 is integrally coupled and fixed to a portion of one side of the cover 220, which seals an upper portion of the first chamber C1. In this case, as shown in FIG. 3, for the fixing, a bracket 251*a* is integrally provided at a valve housing 251 of the three-way valve 250, and the bracket 251*a* is engaged with the cover 220 using bolts or the like. In addition, a cooling water inlet 221 in FIG. 5 for supplementing the cooling water is formed in an upper portion of the cover 220, and the cooling water inlet 221 is openable and closable by a cap 222 which is screw-engaged.

Figure 4:
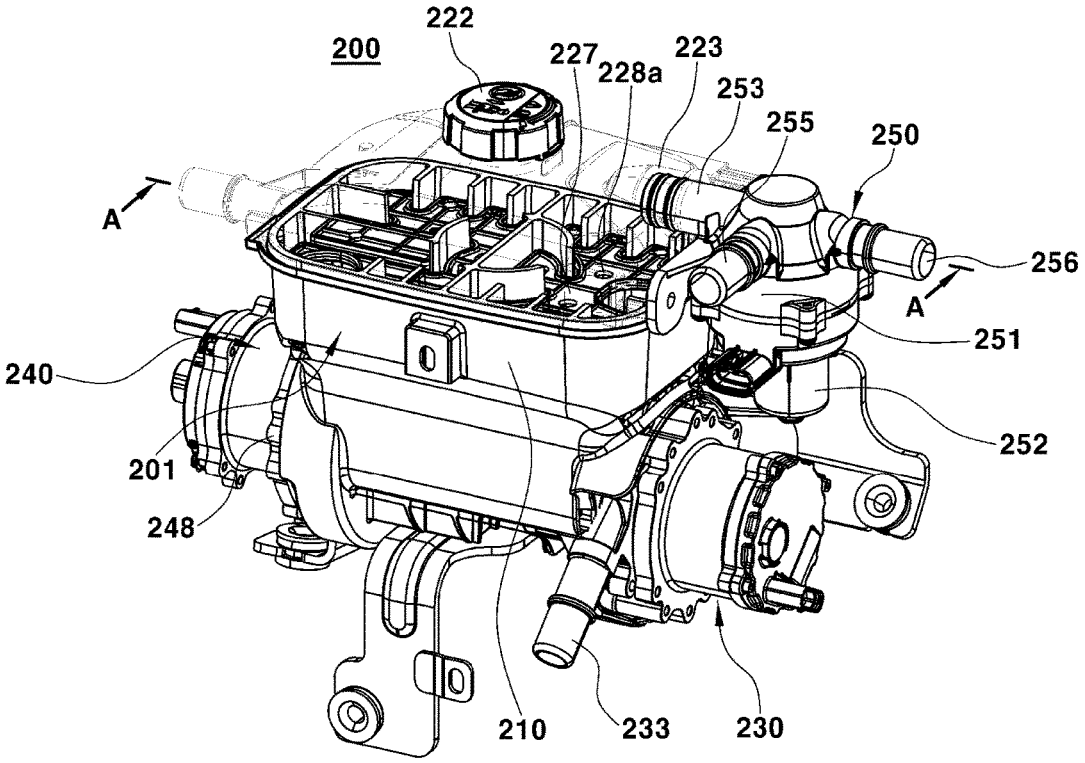
FIG. 4 is a perspective view illustrating a surface of a cover to be transparent and only an outer line of the cover to be visible in the integrated reservoir tank assembly according to the embodiment of the present disclosure.
Figure 5:
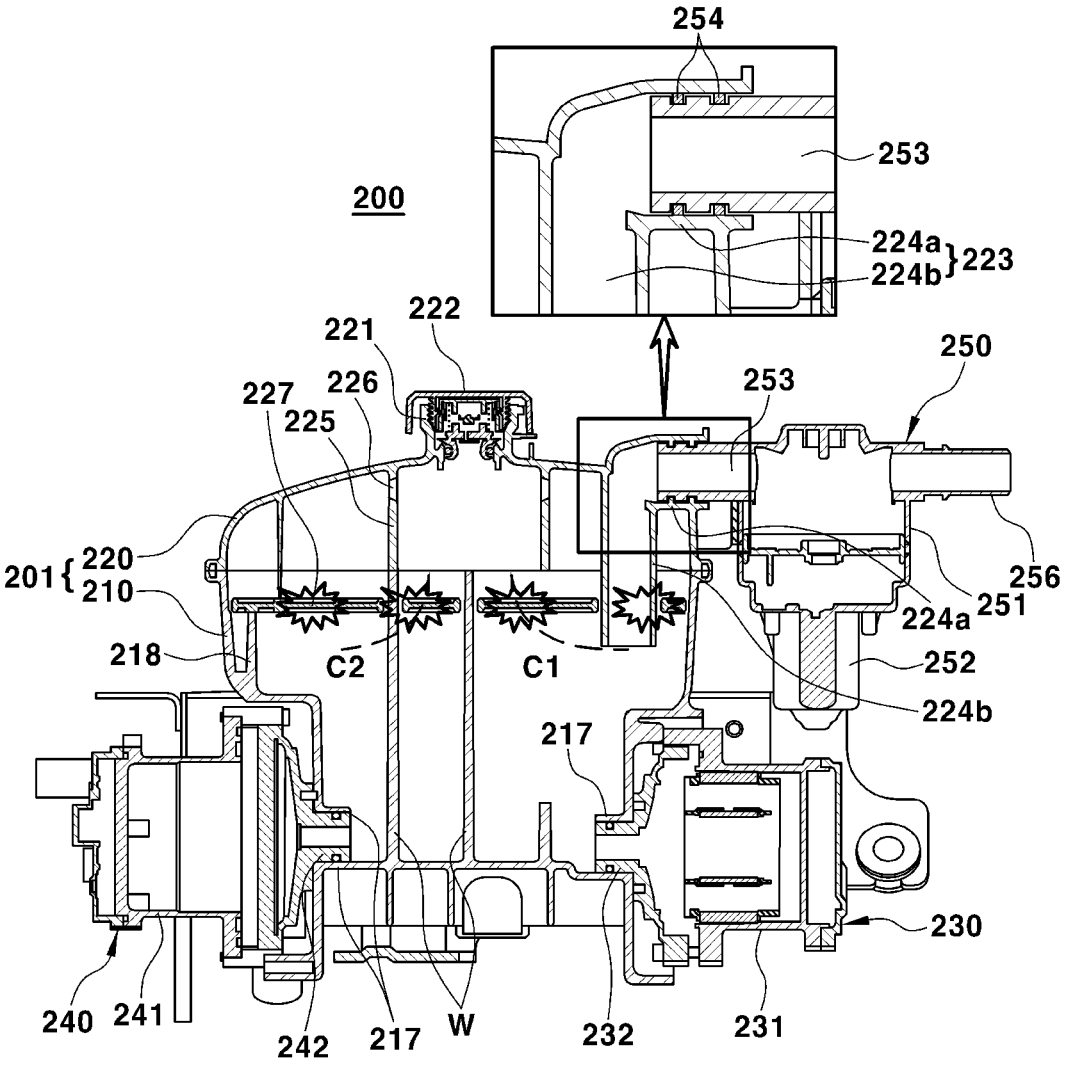
FIG. 5 is a cross-sectional view taken along line A-A of FIG. 4.

FIG. 4 is a perspective view illustrating a surface of the cover 220 to be transparent and only an outer line of the cover 220 to be visible in the reservoir tank assembly 200 according to the embodiment of the present disclosure that shows a state in which an exit port 253 of the three-way valve 250 is inserted into a valve connector 223 of the cover 220. FIG. 5 is a cross-sectional view taken along line A-A of FIG. 4.

Reference numeral "220*a*" in FIG. 4 denotes a first cooling water inlet of the integrated reservoir tank 201 for allowing the cooling water circulating along the second cooling water line 127 to flow into a second chamber (reference numeral "C2" in FIG. 5). As shown in the drawing, the first cooling water inlet 220*a* may be formed on one side of the cover 220 and formed at a position above the second chamber C2 even in the cover 220. Accordingly, the first cooling water inlet 220*a* may be communicated with the second chamber C2 in an inner space of the integrated reservoir tank 201.

In addition, the first cooling water inlet 220*a* is connected to a cooling water outlet of the second radiator 124 through the second cooling water line 127. Accordingly, the cooling water passing through the second radiator 124 flows to the second cooling water line 127 through the cooling water outlet of the second radiator, flows into the second chamber C2 of the integrated reservoir tank 201 from the second cooling water line 127 through the first cooling water inlet 220*a*, and then is pressure transferred to the second cooling circuit 120 by the second electric water pump 122 to be used to cool the battery 146 (see FIG. 2).

The three-way valve 250 is a valve which is connected to the integrated reservoir tank 201, the first bypass line 115, and the cooling water line (first cooling water line) 114 on the first radiator 113 and controls a flow of the cooling water in three directions (see FIG. 2). As shown in FIGS. 3 and 4, the three-way valve 250 has three ports 253, 255, and 256 in total, and the exit port 253 among the three ports 253, 255, and 256 is inserted into and coupled to the cover 220 of the integrated reservoir tank 201.

In this case, a cylindrical-shaped valve connector 223 through which the exit port 253 of the three-way valve 250 is insertable is formed to pass through the cover 220 of the integrated reservoir tank 201, and the valve connector 223 is formed in a portion of the cover 220 which is located on an upper side of the first chamber C1. In addition, the valve connector 223 includes a port insertion part 224*a* extending horizontally, and a guide passage 224*b* formed to extend downward from an end portion of the port insertion part 224*a* (see FIG. 5).

In addition, the exit port 253 of the three-way valve 250 is inserted into and coupled to the port insertion part 224*a* so that an inner passage of the exit port 253 of the three-way valve 250 is spatially connected to an inner space of the cover 220 to allow fluid movement. Thus, the cooling water discharged through the exit port 253 of the three-way valve 250 is allowed to flow to the first chamber C1 of the tank main body 210 along the guide passage 224*b*.

Referring to FIGS. 3 and 4, it can be seen that the three ports 253, 255, and 256 in total are provided in the three-way valve 250, the exit port 253 among the three ports 253, 255, and 256 is coupled to the port insertion part 224*a* formed in the cover 220 of the integrated reservoir tank 201. Thus, the cooling water of the first cooling circuit 110, that is, the cooling water circulating along the first cooling water line 114, may be introduced into the three-way valve 250 and thus may move to be stored in the first chamber C1 of the integrated reservoir tank 201 through the exit port 253 and the guide passage 224*b* of the valve connector 223.

The first bypass line 115 and the cooling water line (first cooling water line) 114 of the first radiator 113 of FIG. 2 are connected to the two remaining inlet ports 255 and 256 among the ports of the three-way valve 250. In the three-way valve 250, due to a valve body (not shown) in the valve housing 251, of which a rotation position is controlled by an actuator 252, a selected one of the two inlet ports 255 and 256 is spatially connected to the exit port 253. Thus, the cooling water passing through the first bypass line 115 or the first radiator 113 may be introduced into the three-way valve 250 and then may move to be stored in the first chamber C1 of the integrated reservoir tank 201 through the exit port 253.

That is, the cooling water passing through the first bypass line 115 may be introduced into the three-way valve 250 through one of the two inlet ports 255 and 256 and then may move to be stored in the first chamber C1 of the integrated reservoir tank 201 through the exit port 253, or the cooling water passing through the first radiator 113 may move along the first cooling water line 114, may be introduced into the three-way valve 250 through the other one of the two inlet ports 255 and 256, and then may move to be stored in the first chamber C1 of the integrated reservoir tank 201 through the exit port 253.

As shown in FIG. 5, in the cover 220, the valve connector 223 has a port insertion part 224*a* which the exit port 253 of the three-way valve 250 is horizontally inserted into and coupled to. A seal ring 254 for sealing fluid (cooling water) is pressed and interposed between an outer circumferential surface of the exit port 253 of the three-way valve 250 and an inner circumferential surface of the port insertion part 224*a* of the cover 220.

In addition, referring to FIG. 5, it can be seen that the valve connector 223 includes the port insertion part 224*a* extending horizontally and the guide passage 224*b* extending vertically downward. Thus, the cooling water discharged through the exit port 253 of the three-way valve 250 moves downward along the guide passage 224*b* of the valve connector 223 and moves to the first chamber C1 of the tank main body 210.

In addition, referring to FIG. 5, a cylindrical-shaped upper partition wall 225 is formed to extend vertically downward on an inner surface of the upper portion of the cover 220 so as to be located below the cooling water inlet 221 with which the cap 222 is engaged in the cover 220. In this case, the cooling water inlet 221 is formed to be located in the upper partition wall 225 in the cover 220. In addition, a plurality of through-holes 226 are formed to pass through the upper partition wall 225 of the cover 220.

The upper partition wall 225 of the cover 220 is coupled to a lower partition wall 212, which will be described below, of the tank main body 210. To this end, the upper partition wall 225 is formed in a cylindrical shape at a position corresponding to the lower partition wall 212 of the tank main body 210 on the inner surface of the upper portion of the cover 220. In this case, the lower partition wall 212 of the tank main body 210 is also formed in a cylindrical shape (see FIG. 7). In a state in which the cover 220 is coupled to the tank main body 210, a lower end surface of the upper partition wall 225 of the cover 220 is coupled to be in contact with an upper end surface of the lower partition wall 212 of the tank main body 210. Thus, the inner space of the integrated reservoir tank 201 is divided into an inner space and an outer space by the upper partition wall 225 and the lower partition wall 212.

Figure 6:
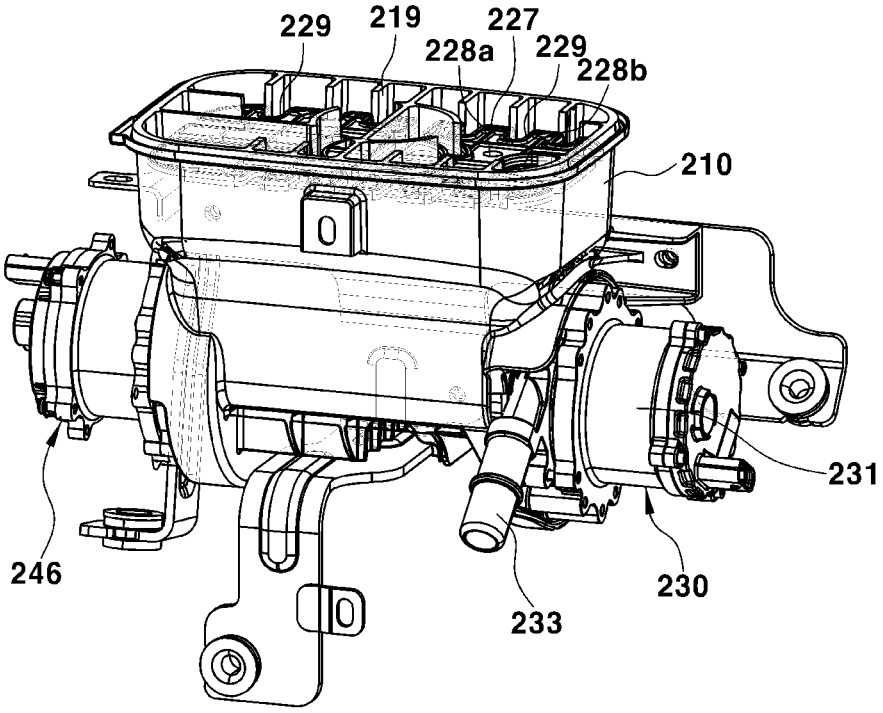
FIG. 6 is a perspective view illustrating a state in which an electric water pump is coupled to a tank main body of an integrated reservoir tank in the integrated reservoir tank assembly according to the embodiment of the present disclosure.
Figure 7:
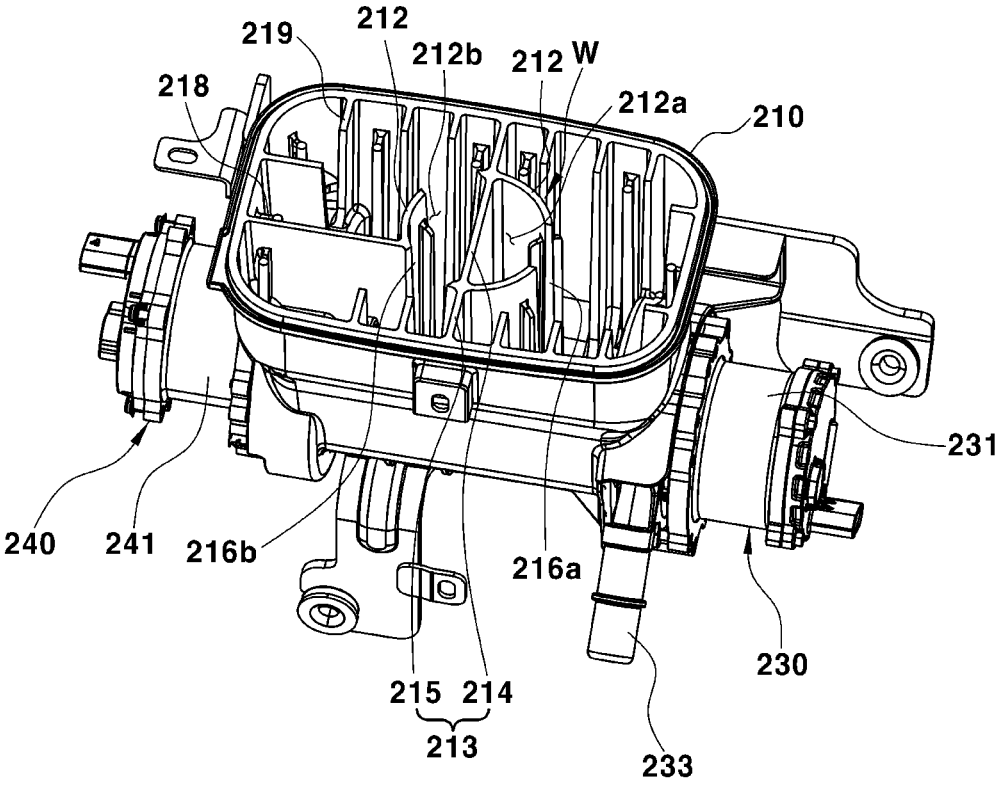
FIG. 7 is a perspective view illustrating a state in which a baffle is removed from the tank main body of the integrated reservoir tank according to the embodiment of the present disclosure.

Next, the tank main body will be described. FIG. 6 is a perspective view illustrating a state in which the electric water pump is coupled to the tank main body of the integrated reservoir tank that shows a state in which the cover is removed from the integrated reservoir tank. In addition, FIG. 7 is a perspective view illustrating a state in which the baffle is removed from the tank main body of the integrated reservoir tank shown in FIG. 6. FIG. 7 shows an arrangement shape and a structure of a partition wall.

As shown in FIGS. 5 and 6, the tank main body 210 of the integrated reservoir tank 201 has an inner space of a predetermined volume, and the inner space is divided into the first chamber C1 and the second chamber C2 by a partition wall W.

In addition, the first electric water pump 230 is coupled to a portion of the first chamber C1 in a lower portion of the tank main body 210, and the second electric water pump 240 is coupled to a portion of the second chamber C2 on the lower portion of the tank main body 210. Each of the electric water pumps 230 and 240 is provided to suction the cooling water stored in the corresponding chamber C1 or C2 and discharge the cooling water through discharge parts 233 and 243, and the cooling water lines 114 and 127 are connected to the discharge parts 233 and 234 of the electric water pumps 230 and 240, respectively. That is, the first cooling water line 114 is connected to the discharge part 233 of the first electric water pump 230, and the second cooling water line 127 is connected to the second electric water pump 240.

Thus, the cooling water stored in the first chamber C1 is suctioned by the first electric water pump 230 and then is transmitted to be circulated along the first cooling water line 114, and the cooling water stored in the second chamber C2 is suctioned by the second electric water pump 240 and then is transmitted to circulate along the second cooling water line 127 (see FIG. 2).

In addition, the inner space of the tank main body 210 is divided into the first chamber C1 and the second chamber C2 by the partition wall W. As shown in FIG. 7, the partition wall W includes a main partition wall 213 formed to be disposed in a transverse direction in the inner space of the tank main body 210 to divide the inner space of the tank main body into the first chamber C1 and the second chamber C2. In this case, the main partition wall 213 is formed to connect between two facing side surfaces of the tank main body 210 in the inner space thereof and thus is provided in an arrangement structure which crosses the inner space of the tank main body 210 in the transverse direction.

In addition, the partition wall W includes the cylindrical-shaped lower partition wall 212 formed at a position corresponding to the upper partition wall 225 of the cover 220 in a central portion of the inner space of the tank main body 210. In this case, the lower partition wall 212 is formed to extend upward from an inner bottom of the tank main body 210 to be elongated and is formed in a cylindrical shape having a predetermined height from the inner bottom of the tank main body 210.

In this case, the upper end surface of the lower partition wall 212 of the tank main body 210 is coupled to be in contact with the lower end surface of the upper partition wall 225 of the cover 220 (see FIG. 5). Thus, the upper partition wall 225 of the cover 220 and the lower partition wall 212 of the tank main body 210 generally constitute a cylindrical-shaped partition wall structure in the central portion of the inner space of the tank main body 210.

In the embodiment of the present disclosure, the lower partition wall 212 is formed to have a structure connected to the main partition wall 213. Specifically, the main partition wall 213 may be disposed in a straight line to pass through a center of the lower partition wall 212. In this case, as shown in FIG. 7, the main partition wall 213 includes an inner partition wall 214 which partitions the inner space of the lower partition wall 212, and an outer partition wall 215 which partitions the inner space of the tank main body 210 into the first chamber C1 and into the second chamber C2 outside the lower partition wall 212.

The inner partition wall 214 may be formed to pass through an inner center of the lower partition wall 212 in a straight line, and the outer partition wall 215 may be formed to connect between the outer surface of the lower partition wall 212 and the inner surface of the tank main body 210 in a straight line. In this case, the inner partition wall 214 and the outer partition wall 215 may be generally formed to be disposed on a straight line. That is, the inner partition wall 214 and the outer partition wall 215 are connected and disposed in a straight line to generally form a straight line-shaped main partition wall 213.

The inner partition wall 214 partitions the inner space of the lower partition wall 212 into two spaces 212*a* and 212*b* (two divisions), and the outer partition wall 215 partitions the outer space of the lower partition wall 212 into a first chamber-side space 212*a* and a second chamber-side space 212*b*. In this case, a passage hole 216*a* is formed in the lower partition wall 212 to spatially connect one of the two spaces 212*a* and 212*b*, which are partitioned by the inner partition wall 214, to the first chamber C1. In addition, a passage hole 216*b* is formed in the lower partition wall 212 to spatially connect the remaining one of the two spaces 212*a* and 212*b*, which are partitioned by the inner partition wall 214, to the second chamber C2.

In the embodiment of the present disclosure, the partition wall W of the tank main body 210 is to prevent the cooling water of the first cooling circuit 110 stored in the first chamber C1 and the cooling water of the second cooling circuit 120 stored in the second chamber C2 from being mixed in the integrated reservoir tank 201. In this case, the inner partition wall 214 serves to prevent the cooling water on both sides from being mixed in the lower partition wall 212, and the outer partition wall 215 serves to prevent the cooling water on the both sides from being mixed outside the lower partition wall 212 and inside the tank main body 210.

In addition, the passage holes 216*a* and 216*b* of the lower partition wall 212 are holes through which the cooling water injected into the two spaces 212*a* and 212*b* of the lower partition wall 212 is introduced into and distributed to the first chamber C1 and the second chamber C2. That is, when the cooling water is injected into the integrated reservoir tank 201, the cooling water is injected into an inner space 225*a* of the upper partition wall 225 through the cooling water inlet 221 of the cover 220. The cooling water injected into the inner space 225*a* of the upper partition wall 225 is divided to flow to the two spaces 212*a* and 212*b* of the lower partition wall 212 partitioned by the inner partition wall 214. In this case, the passage holes 216*a* and 216*b* are formed at designated positions of the lower partition wall 212 so as to allow the cooling water injected into the two spaces 212*a* and 212*b* of the lower partition wall 212 to flow to the first chamber C1 and the second chamber C2 which are outer spaces of the lower partition wall 212.

Figure 8:
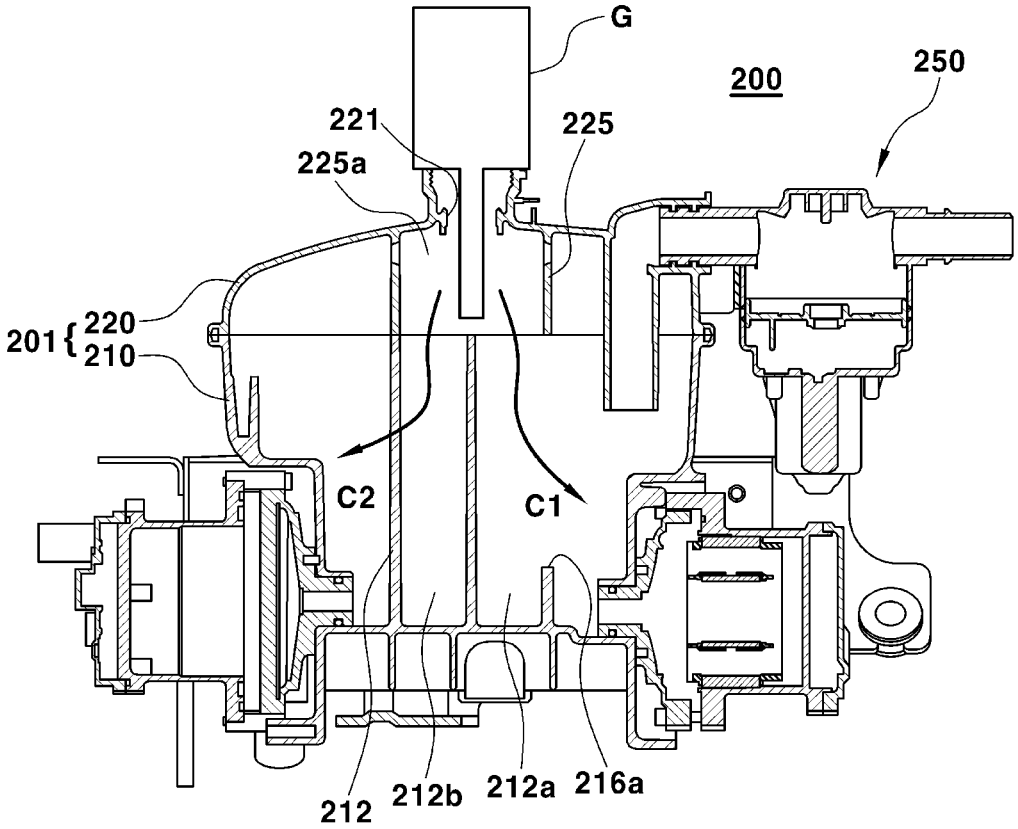
FIG. 8 is a cross-sectional view illustrating a state in which cooling water is distributed to flow when the cooling water is injected into the integrated reservoir tank by a cooling water injection gun according to the embodiment of the present disclosure.

FIG. 8 is a cross-sectional view illustrating a state in which the cooling water is distributed to flow to the first chamber C1 and the second chamber C2 when the cooling water is injected into the integrated reservoir tank 201 using a cooling water? injection gun G. As shown in the drawing, the inner space 225*a* of the upper partition wall 225 formed in the cover 220 is not partitioned, whereas an inner space of the lower partition wall 212 formed in the tank main body 210 is partitioned into the first chamber-side space 212*a* and the second chamber-side space 212*b* by the inner partition wall 214.

In addition, when coupled to each other on upper and lower sides, the upper partition wall 225 and the lower partition wall 212 form a cylindrical-shaped partition wall in the central portion of the integrated reservoir tank 201. The inner space 225*a* of the upper partition wall 225 is one space not partitioned, whereas the inner space of the lower partition wall 212 is partitioned into the two spaces 212*a* and 212*b* by the inner partition wall 214 of the main partition wall 213. In this case, one of the two spaces 212*a* and 212*b* partitioned by the inner partition wall 214 in the inner space of the lower partition wall 212 is the first chamber-side space 212*a* filled with the cooling water of the first cooling circuit 110, and the other one of the partitioned two spaces is the second chamber-side space 212*b* filled with the cooling water of the second cooling circuit 120.

In addition, the first chamber-side space 212*a* among the inner spaces of the lower partition wall 212 is spatially connected to the first chamber C1, which is the outer space of the lower partition wall 212, through the passage hole 216*a* so as to allow the cooling water to move, and the second chamber-side space 212*b* among the inner spaces of the lower partition wall 212 is spatially connected to the second chamber C2, which is the outer space of the lower partition wall 212, through the passage hole 216*b* so as to allow the cooling water to move.

Thus, in order to primally inject the cooling water into the integrated reservoir tank 201 in a vehicle assembly process or supplement the cooling water into the integrated reservoir tank 201 in the vehicle during traveling, as shown in FIG. 8, the cooling water inlet 221 of the cover 220 is opened by turning the cap 222, the cooling water injection gun G is inserted into the cooling water inlet 221, and then the cooling water is injected through the cooling water injection gun G. In this case, the cooling water injected through the cooling water injection gun G is uniformly distributed to flow to the partitioned two spaces of the lower partition wall 212 in the inner space 225*a* of the upper partition wall 225, that is, the first chamber-side space 212*a* and the second chamber-side space 212*b*.

Subsequently, the cooling water distributed into the first chamber-side space 212*a* and the second chamber-side space 212*b* in the lower partition wall 212 passes through the passage holes 216*a* and 216*b* of the lower partition wall 212 and moves to the first chamber C1 and the second chamber C2 which are the outer spaces of the lower partition wall 212. Thus, the cooling water injected into the inner space of the integrated reservoir tank 201 by the cooling water injection gun G may be uniformly distributed and injected into the first chamber C1 and the second chamber C2. Even after the injection, the cooling water of the first chamber C1 and the cooling water of the second chamber C2 are not mixed with each other due to the lower partition wall 212.

However, the inner space 225*a* of the upper partition wall 225 and the inner spaces 212*a* and 212*b* of the lower partition wall 212 are independent spaces provided for the injection of the cooling water, whereas the inner space 225*a* of the upper partition wall 225 is a common space into which all of the cooling water of the first chamber C1 and the cooling water of the second chamber C2 may be introduced. Thus, there is a probability in that the cooling water of the first chamber C1 (the cooling water of the first cooling circuit) and the cooling water of the second chamber C2 (the cooling water of the second cooling circuit) are mixed through the inner space 225*a* of the upper partition wall 225. However, a space in which the cooling water of the first chamber C1 and the cooling water of the second chamber C2 may be mixed is only the inner space 225*a* of the upper partition wall 225 formed in the cover 220. When the vehicle is traveling, a mixed amount of the cooling water on the both sides due to occurrence of sloshing of the cooling water through the inner space 225*a* of the upper partition wall 225 is very insignificant.

Meanwhile, in electric vehicles, temperature management for each part by the water cooling system is very important, and the temperature management is directly connected to electricity efficiency of the electric vehicles. Thus, in a cooling system in which management temperatures for parts are different, it is important to prevent the cooling water of the first cooling circuit 110 (the cooling water of the first chamber C1) and the cooling water of the second cooling circuit 120 (the cooling water of the second chamber C2), which are stored in the integrated reservoir tank 201, from being mixed with each other. Thus, in order to minimize mixing of the cooling water on the both sides stored in the integrated reservoir tank 201 due to sloshing, a baffle 227 may be installed in the inner space of the integrated reservoir tank 201.

That is, as shown in FIGS. 5 and 6, the plate-shaped baffle 227 is installed in the inner space of the first chamber C1 and the inner space of the second chamber C2. In this case, the baffle 227 is installed to be horizontally disposed in an upper portion of the inner space of the corresponding chamber C1 or C2. In addition, a support 218 of a predetermined height is formed to extend vertically to be located in each chamber on the inner surface of the tank main body 210 so as to horizontally fix and support the baffle 227 in the inner space of each of the chambers C1 and C2.

The support 218 may be formed at a predetermined height on the inner surface of the tank main body 210, for example, at the bottom of the tank main body 210, and a plurality of supports 218 may be formed at the same height at a plurality of positions on the inner surface of the tank main body 210. Thus, in each of the chambers C1 and C2 of the tank main body 210, the baffle 227 may be horizontally disposed in a state of being supported on the plurality of supports 218.

A through-hole 228*a* through which the cooling water passes may be formed in the baffle 227 installed in each of the chambers C1 and C2. In addition, a guide through-hole 228*b* through which the guide passage 224*b* of the cover 220 may pass is formed in a baffle 227 installed in the first chamber C1 among the baffles 227 of each of the chambers C1 and C2. Thus, the cover 220 is assembled such that the guide passage 224*b* extending vertically downward passes through the guide through-hole 228*b* of the baffle 227, and a lower exit of the guide passage 224*b* is located below the baffle 227. Eventually, the cooling water is discharged into a space below the baffle 227 through the exit port 253 of the three-way valve 250 even in the first chamber C1.

In addition, fitting protrusion 219 are formed to protrude from the inner surface of the tank main body 210, especially the inner surfaces of the first chamber C1 and the second chamber C2 in the tank main body 210, and fitting grooves 229 into which the fitting protrusions 219 on the inner surfaces of the first chamber C1 and the second chamber C2 are insertable are formed at an edge of the baffle 227 installed in the first chamber C1 and the second chamber C2. In this case, a plurality of fitting grooves 229 disposed at predetermined intervals along an overall circumference of the baffle 227 may be formed. In addition, a plurality of fitting protrusions 219 may be formed to be inserted one by one into the fitting grooves 229 of the baffle 227 along an overall circumference of the inner surface of each of the chambers C1 and C2.

As described above, in a state in which the fitting protrusion 219 is inserted into the fitting groove 229, the baffle 227 is installed in each of the chambers C1 and C2 so that the baffle 227 may be stably maintained in a horizontal state and at a position without being biased to one side in each of the chambers C1 and C2 and without being swayed. As described above, while the vehicle is traveling, the baffle 227 installed in the integrated reservoir tank 201 minimizes the sloshing of the cooling water stored in the first chamber C1 and the second chamber C2 and prevents the cooling water stored in the first chamber C1 and the cooling water stored in the second chamber C2 from being mixed.

Hereinafter, a coupling structure between the integrated reservoir tank and the electric water pump will be described in detail. Since a state in which the first electric water pump 230 and the second electric water pump 240 are coupled to the tank main body 210 of the integrated reservoir tank 201 is shown even in FIGS. 4 and 8, a description will be made with reference to FIGS. 4 and 8.

Figure 9:
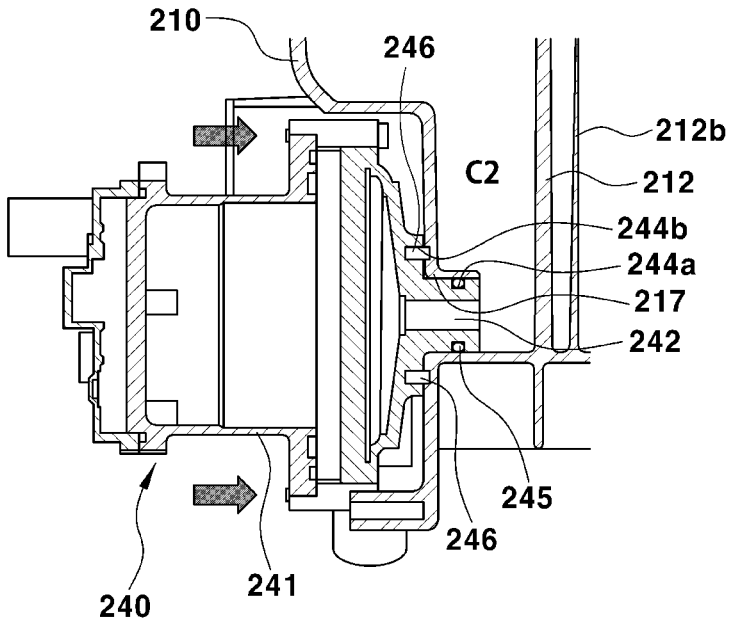
FIG. 9 is a cross-sectional view illustrating a state in which a second electric water pump is coupled to the integrated reservoir tank in the integrated reservoir tank assembly according to the embodiment of the present disclosure.

In addition, FIG. 9 is a cross-sectional view illustrating a state in which the second electric water pump 240 is coupled to a portion of the second chamber of the integrated reservoir tank 201 in the integrated reservoir tank assembly 200 according to the embodiment of the present disclosure. In the drawing, illustration of an internal configuration of the second electric water pump 240 is omitted.

Figure 10:
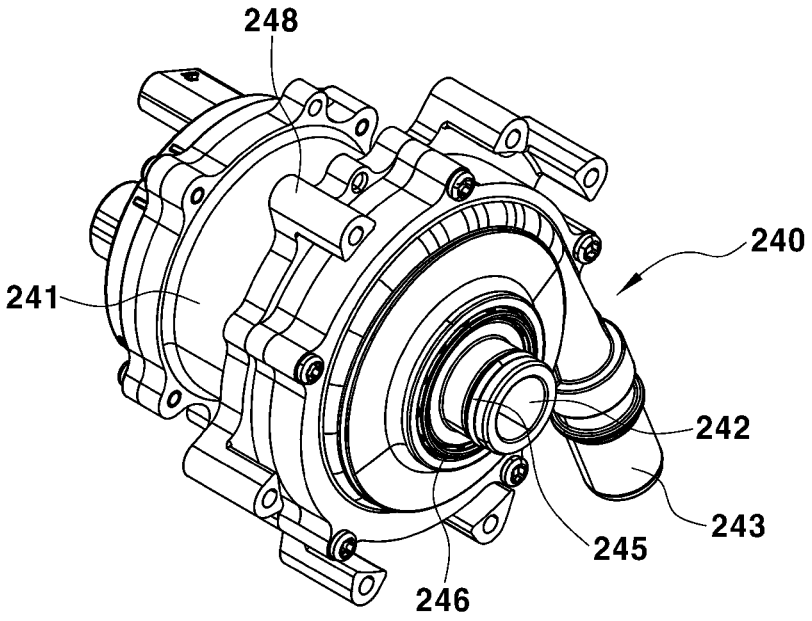
FIG. 10 is a perspective view illustrating the second electric water pump in the integrated reservoir tank assembly according to the embodiment of the present disclosure.
Figure 11:
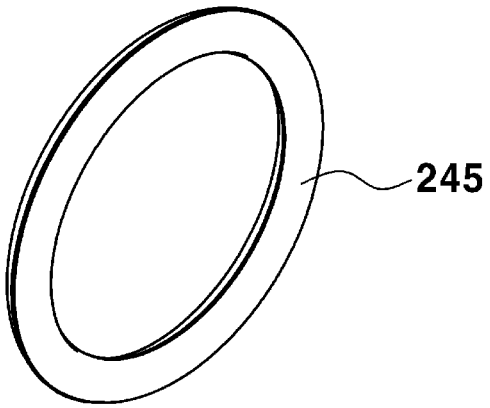
FIG. 11 is a perspective view illustrating a first O-ring used between the electric water pump and the integrated reservoir tank according to the embodiment of the present disclosure.
Figure 12:
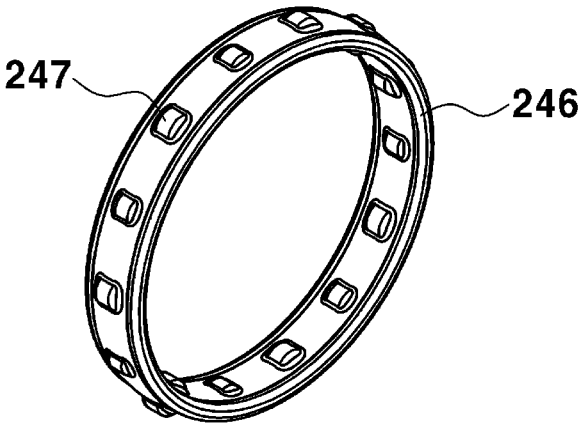
FIG. 12 is a perspective view illustrating a second O-ring used between the electric water pump and the integrated reservoir tank according to the embodiment of the present disclosure.

FIG. 10 is a perspective view illustrating the second electric water pump in the integrated reservoir tank assembly according to the embodiment of the present disclosure. FIG. 11 is a perspective view illustrating a first O-ring 245, which is a side pressure O-ring, press interposed between the discharge part 243 of the second electric water pump 240 and a pump insertion part 217 of the tank main body 210 according to the embodiment of the present disclosure, and FIG. 12 is a perspective view illustrating a second O-ring 246, which is a surface pressure O-ring, press interposed between a pump housing 241 of the second electric water pump 240 and the tank main body 210 according to the embodiment of the present disclosure.

Figure 13:
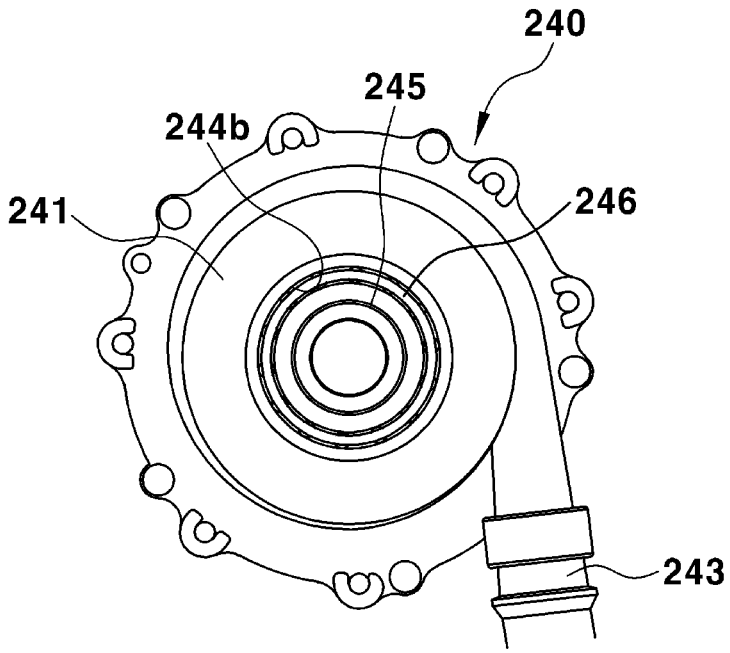
FIG. 13 is a front view illustrating a state in which the second O-ring is installed in the second electric water pump according to the embodiment of the present disclosure.
Figure 14:
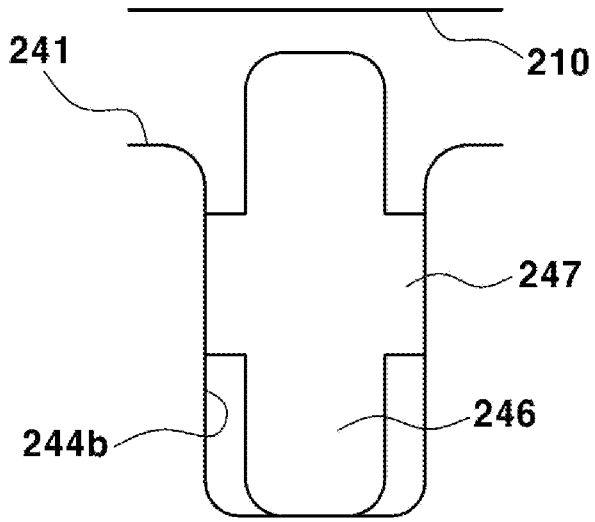
FIG. 14 is a cross-sectional view illustrating a state in which the second O-ring is inserted into and seated in a ring groove according to the embodiment of the present disclosure.

In addition, FIG. 13 is a front view illustrating a state in which the second O-ring 246, which is a surface pressure O-ring, is installed in the second electric water pump 240 according to the embodiment of the present disclosure, and FIG. 14 is a cross-sectional view illustrating a state in which the second O-ring 246, which is a surface pressure O-ring, is inserted into and seated in a ring groove 244*b* according to the embodiment of the present disclosure.

As can be seen from FIG. 8, a structure in which the first electric water pump 230 is coupled to and mounted on the tank main body 210 of the integrated reservoir tank 201 is not different from a structure in which the second electric water pump 240 is coupled to and mounted on the tank main body 210 of the integrated reservoir tank 201. Thus, in the following description, the coupling and mounting structure of the second electric water pump 240 is equally applied to the first electric water pump 230. FIGS. 9 to 12 illustrate the second electric water pump 240 and the O-rings 245 and 246 thereof.

First, the discharge parts 233 and 243 are provided on one sides of the pump housings 231 and 241 of the first electric water pump 230 and the second electric water pump 240, and the cooling water lines 114 and 127 (see FIGS. 1 and 2) are connected to the discharge parts 233 and 243. That is, the cooling water line (first cooling water line) 114 of the first cooling circuit 110 is connected to the discharge part 233 of the first electric water pump 230, and the cooling water line (second cooling water line) 127 of the second cooling circuit 120 is connected to the discharge part 243 of the second electric water pump 240.

In addition, the suction parts 232 and 242 are provided on the other sides of the pump housings 231 and 241 of the first electric water pump 230 and the second electric water pump 240, and the suction parts 232 and 242 are inserted into and coupled to the tank main body 210 of the integrated reservoir tank 201. In this case, the pump insertion part 217 is formed to pass through the lower side of each of the first chamber and the second chamber of the tank main body 210. The pump insertion part 217 is formed in a cylindrical shape, and the suction parts 232 and 242 of the electric water pump are inserted into and coupled to the pump insertion parts 217.

As shown in FIG. 9, the pump insertion part 217 to which the second electric water pump 240 is coupled is formed in the lower side of the second chamber even in the tank main body 210 of the integrated reservoir tank 201, and the suction part 242 of the second electric water pump 240 is inserted into and coupled to the pump insertion part 217 of the tank main body 210.

As shown in FIG. 10, the suction part 242 is formed in a cylindrical shape protruding forward from a central portion of a front side of the pump housing 241 of the second electric water pump 240. In a state in which the suction part 242 of the second electric water pump 240 is inserted into the pump insertion part 217 of the tank main body 210, the cylindrical-shaped suction part 242 and the cylindrical-shaped pump insertion part 217 form an overlapping, coupled, and disposed structure inside and outside.

In the embodiment of the present disclosure, in a state in which the suction parts 232 and 242 of the electric water pumps 230 and 240 are inserted into the pump insertion part 217 of the tank main body 210, the pump housings 231 and 241 are engaged with the tank main body 210 using bolts (not shown) and nuts 249 so that the electric water pumps 230 and 240 are integrally coupled to the tank main body 210. For fluid sealing, the first O-ring 245, which is a side pressure O-ring as illustrated in FIG. 11, is press interposed between an inner circumferential surface of the pump insertion part 217 of the tank main body 210 and outer circumferential surfaces of the suction parts 232 and 242 of the electric water pumps 230 and 240.

Referring to FIG. 10, it can be seen that a ring groove 244*a* is formed on the outer circumferential surface of the suction part 242 of the second electric water pump 240, and the first O-ring 245, which is a side pressure O-ring, is mounted on the ring groove 244*a*. As described above, in a state in which the first O-ring 245 is mounted on the outer circumferential surface of the suction part 242 of the second electric water pump 240 through the ring groove 244*a*, after the suction part 242 is inserted into the pump insertion part 217 of the tank main body 210, the first O-ring 245 achieves fluid sealing to prevent leakage from occurring between the circumferential surface of the suction part 242 and the circumferential surface of the pump insertion part 217 in a state of being pressed therebetween. As described above, regardless of an engagement force between the electric water pumps and the integrated reservoir tank, compression of the first O-ring 245, which is a side pressure O-ring, is achieved due to a pressure acting between the outer circumferential surfaces of the suction part and the inner circumferential surface of the pump insertion part, and the fluid sealing due to the first O-ring 245 is achieved.

In addition, a ring groove 244*b* is formed in a circular shape along an outer periphery of the suction part 242 on a front surface of the pump housing 241 of the second electric water pump 240, and the second O-ring 246, which is a surface pressure O-ring as illustrated in FIG. 12, is mounted in the ring groove 244*b*. In the embodiment of the present disclosure, the second O-ring 246 has a flat transverse cross-sectional shape and is provided in a shape having a predetermined thickness and a predetermined width. In addition, a plurality of protrusions 247 are formed on an inner circumferential surface and an outer circumferential surface of the second O-ring 246 at regular intervals along an entire circumference in a circumferential direction.

Eventually, when the front surface of the pump housing 241 of the second electric water pump 240 is coupled to a corresponding portion of an outer surface of the tank main body 210 in a state of being pressed against the corresponding portion, the second O-ring 246 is press interposed between the pump housing 241 and the tank main body 210. Thus, due to the engagement force acting when the second electric water pump 240 is engaged with and fixed to the integrated reservoir tank 201, the second O-ring 246 performs a sealing function in the form of face-to-face compression between a surface of the pump housing 241 (an inner surface of the ring groove) and a surface of the tank main body 210 of the integrated reservoir tank 201.

In addition, as shown in FIG. 14, in a state in which the second O-ring 246 is inserted into and seated on the ring groove 244*b* of the pump housing 241, the inner and outer circumferential surfaces of the second O-ring 246 may be spaced apart from an inner circumferential surface of the ring groove 244*b*. However, when the second electric water pump 240 is coupled to the integrated reservoir tank 201, the pump housing 241 is pressed against the outer surface of the tank main body 210 and thus the second O-ring 246, which is a surface pressure O-ring, is compressed by the outer surface of the tank main body 210, and when compressed, the inner and outer circumferential surfaces of the second O-ring 246 are pressed against the inner surface of the ring groove 244*b* so that desired fluid sealing may be achieved.

However, before the compression, since the inner and outer circumferential surfaces of the second O-ring 246 may be spaced apart from the inner surface of the ring groove 244*b*, when the protrusions 247 are not present, the second O-ring 246 may move in the ring groove 244*b* so that the second O-ring 246 may be disposed to be offset from a concentric position with the cylindrical-shaped suction part 242. However, when the protrusions 247 are formed on the inner and outer circumferential surfaces of the second O-ring 246, and even when the inner and outer circumferential surfaces thereof are spaced apart from the inner surface of the ring groove 244*b*, since the protrusions 247 remain in a state of being in contact with the inner surface of the ring groove 244*b*, the second O-ring 246 may be fixed without moving in the ring groove 244*b*.

Thus, the protrusions 247 formed on the inner and outer circumferential surfaces of the second O-ring 246 at regular intervals along the circumferential direction may be in line contact with the inner surface of the ring groove 244*b*, and the second O-ring 246 may maintain concentricity with the cylindrical-shaped suction part 242 in a state of being inserted into the ring groove 244*b* due to the protrusions 247. In addition, when the second O-ring 246 is inserted into the ring groove 244*b* of the pump housing 241, since the protrusions 247 of the second O-ring 246 are in contact with the inner surface of the ring groove 244*b*, during transportation, the second O-ring 246 may be prevented from being separated from the ring groove 244*b* due to the protrusions 247.

In addition, in order to fix the electric water pumps 230 and 240 to the integrated reservoir tank 201, the pump housings 231 and 241 may be engaged with the tank main body 210 using bolts (not shown) and the nuts 249. For the above engagement, engagement parts 248 through which bolts are inserted are formed in the pump housings 231 and 241, and the nuts 249 are inserted at engagement positions of the tank main body 210 in advance. That is, when the tank main body 210 is injection-molded, the nuts 249 are inserted at the engagement positions and are injection-molded.

Figure 15:
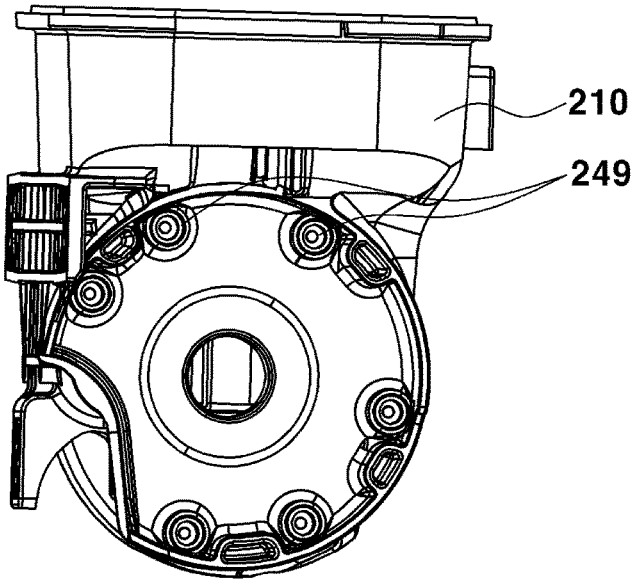
FIG. 15 is a diagram illustrating a state in which a nut is inserted at each engagement position of the tank main body in the integrated reservoir tank assembly according to the embodiment of the present disclosure.

FIG. 15 is a diagram illustrating a state in which the nuts 249 are inserted at the engagement positions of the tank main body 210 in the reservoir tank assembly 200 according to the embodiment of the present disclosure. A plurality of engagement parts 248 may be formed along a periphery of a bonded surface with the tank main body 210 in the pump housings 231 and 241 of the electric water pumps 230 and 240, and the nut 249 may be inserted at a position corresponding to each engagement part in the tank main body 210. Thus, in a state in which the pump housings 231 and 241 are bonded to the outer surface of the tank main body 210, when a bolt (not shown) passes through and is inserted into each engagement part 248 to be engaged with the nut 249 of the tank main body 210, the electric water pumps 230 and 240 may be fixed to the integrated reservoir tank 201.

As described above, the reservoir tank assembly according to the embodiment of the present disclosure is described in detail. According to the above-described reservoir tank assembly, it is possible to reduce the number of reservoir tanks, achieve reduction in production cost and weight, easily secure an installation space, easily achieve an arrangement, and solve a problem of a disadvantageous layout of a space in the vehicle and a problem of degradation in productivity. In addition, not only the number of assembly parts is reduced, but also the number of injections of cooling water is reduced so that there is an effect in that in-line assembly man-hours are reduced, assemblability is improved, and a production cost is reduced.

Figure 16:
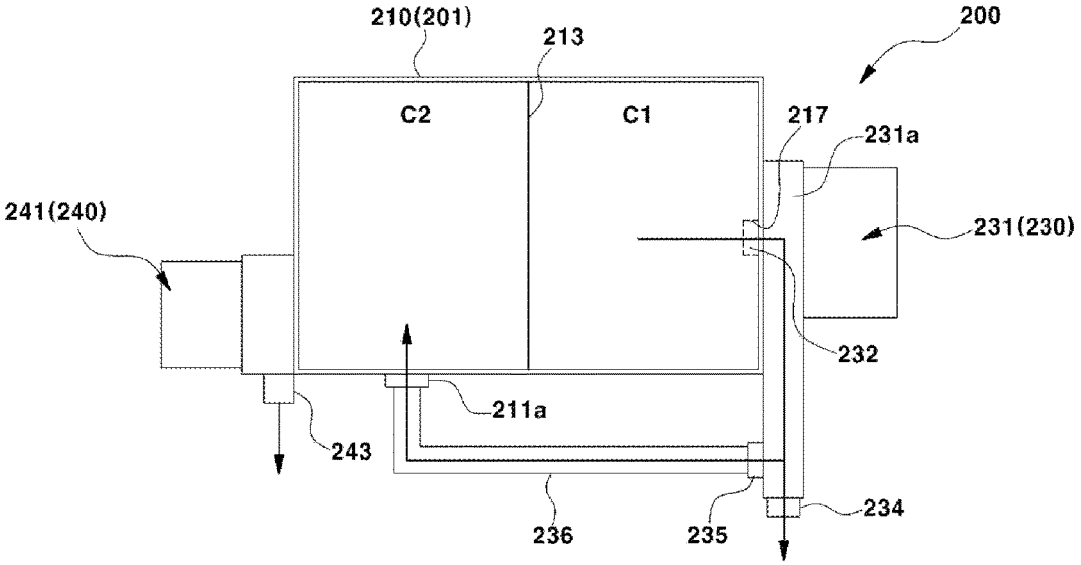
FIGS. 16 and 17 are diagrams illustrating a configuration of a reservoir tank assembly according to another embodiment of the present disclosure.
Figure 17:
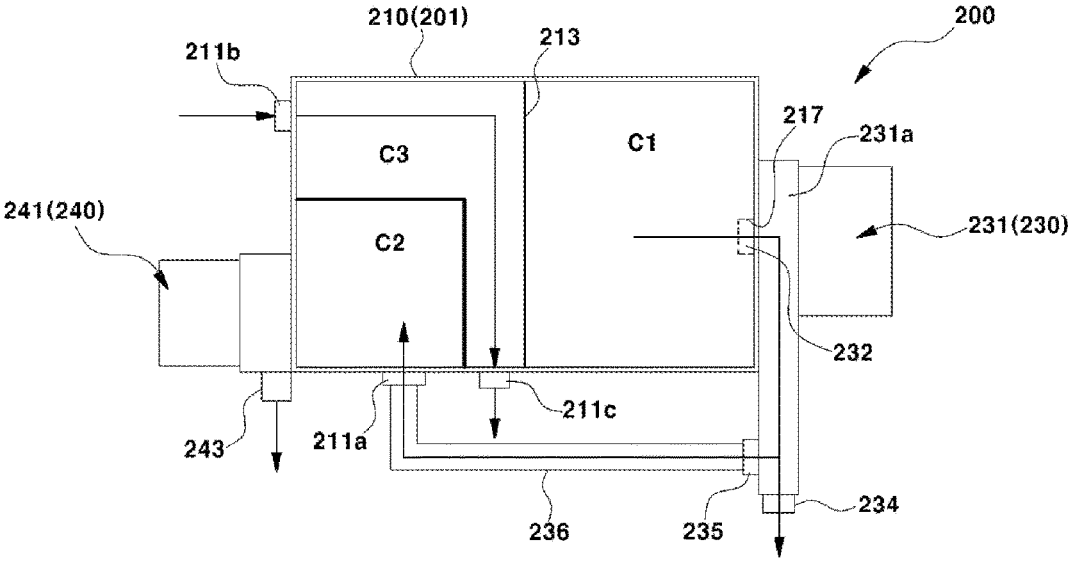

Meanwhile, FIGS. 16 and 17 are diagrams illustrating a configuration of a reservoir tank assembly according to another embodiment of the present disclosure. A reservoir tank assembly 200 of another embodiment shown in FIGS. 16 and 17 is not different in main components from the above-described reservoir tank assembly of the embodiment shown in FIGS. 3 to 8 described above.

As in the embodiment of FIGS. 3 to 9, even in the reservoir tank assembly 200 of the embodiment shown in FIGS. 16 and 17, the three-way valve (reference numeral "250" in FIG. 3) is installed in the same manner. However, it is noted that the three-way valve is omitted from FIGS. 16 and 17. In FIGS. 16 and 17, arrows indicate a flow path and a direction of the cooling water.

In the embodiment of FIGS. 16 and 17, a pump housing 231 of a first electric water pump 230 has a manifold 231*a*. In addition, in the embodiment of FIGS. 16 and 17, the reservoir tank assembly 200 includes a branch pipe 236 which is installed to separately connect the manifold 231*a* to a tank body 210 of an integrated reservoir tank 201.

The manifold 231*a* has a suction part 232, and the suction part 232 is inserted into and coupled to a pump insertion part 217 formed in the tank body 210 of the integrated reservoir tank 201. As described above, the manifold 231*a* may be a part connected to the tank body 210 of the integrated reservoir tank 201 in a pump housing 231 of the first electric water pump 230.

In this case, the suction part 232 of the manifold 231*a* serves as a suction part of the first electric water pump 230 and may be coupled to the tank body 210 of the integrated reservoir tank 201 in the same structure as the embodiment shown in FIGS. 3 to 8. That is, even in the tank body 210 of the integrated reservoir tank 201, the suction part 232 of the manifold 231*a* is inserted into and coupled to the pump insertion part 217 formed at a position of a first chamber C1. Accordingly, the inner space of the manifold 231*a* is communicated with the first chamber C1.

In addition, the manifold 231*a* has two discharge parts, that is, a first discharge part 235 to which the branch pipe 236 is connected, and a second discharge part 234 to which a cooling water line is connected. In the manifold 231*a*, both of the first discharge part 235 and the second discharge part 234 serve as the discharge part of the first electric water pump 230 and are parts where the cooling water suctioned by the first electric water pump 230 in the manifold 231*a* is discharged.

As described above, in the embodiment of FIGS. 16 and 17, the first electric water pump 230 has the two discharge parts 234 and 235, and thus when the first electric water pump 230 is driven, the cooling water suctioned by the first electric water pump 230 in the first chamber C1 of the integrated reservoir tank 201 passes through the manifold 231*a* and then is discharged through the two discharge parts 234 and 235. The branch pipe 236 is connected to the first discharge part 235 of the manifold 231*a* and is installed to connect between the first discharge part 235 of the manifold 231*a* and the tank body 210 of the integrated reservoir tank 201. In this case, even in the tank body 210 of the integrated reservoir tank 201, the branch pipe 236 is connected to a position of a second chamber C2.

To this end, a second coolant inlet 211*a* is provided at the position of the second chamber C2 in the tank body 210 of the integrated reservoir tank 201, and the branch pipe 236 is connected to the second coolant inlet 211*a*.

Consequently, a portion of the cooling water pressure transferred by the first electric water pump 230 may be distributed to flow from the manifold 231*a* to the branch pipe 236 and then may flow from the branch pipe 236 to the chamber C2 of the integrated reservoir tank 201.

Eventually, when the first electric water pump 230 is driven, the cooling water filling in the first chamber C1 of the integrated reservoir tank 201 is suctioned into the manifold 231*a* of the first electric water pump 230, and then a portion of the cooling water flows from the manifold 231*a* to a first cooling target component along a cooling water line (not shown) connected to the second discharge part 234, thereby cooling the first cooling target component to which the cooling water line is connected.

In this case, the remaining portion of the cooling water flows from the manifold 231*a* along the branch pipe 236 connected to the first discharge part 235 and flows into the second chamber C2 of the integrated reservoir tank 201. Then, the cooling water flowing into the second chamber C2 is pressure transferred by a second electric water pump 240 along another cooling water line and is used to cool a second cooling target component.

In the embodiment of FIGS. 16 and 17, the first cooling water inlet 220*a* shown in FIG. 4 is omitted. In the embodiment of FIGS. 16 and 17, when the cooling water stored in the first chamber C1 of the integrated reservoir tank 201 is pressure transferred from the manifold 231*a* due to the driving of the first electric water pump 230, the cooling water is distributed into two paths and is pressure transferred. A portion of the cooling water, which is pressure transferred by the first electric water pump 230 and is distributed from the manifold 231*a*, flows along a path of "the manifold 231*a*→the second discharge part 234→the cooling water line→the first cooling target component" to cool the first cooling target component.

In this case, the remaining portion of the cooling water distributed from the manifold 231*a* flows along a path of "the manifold 231*a*→the first discharge part 235→the branch pipe 236→the second chamber C2 of integrated reservoir tank 201→the second electric water pump 240→the cooling water line→the second cooling target component" to cool the second cooling target component.

Unlike the circuit configuration of FIG. 2, the reservoir tank assembly 200 having the above configuration is applicable to a cooling system in which the cooling water flows in parallel to the first cooling target component and the second cooling target component. In this case, the first cooling target component may be front wheel motors, or the first cooling target component may include a front wheel motor and a front wheel inverter. The second cooling target component may be rear wheel motors, or the second cooling target component may include a rear wheel motor and a rear wheel inverter.

In addition, when compared with the embodiment of FIG. 16, in an embodiment of FIG. 17, the second chamber C2 of the integrated reservoir tank 201 is partitioned by an additional partition wall 213*a*. Thus, an integrated reservoir tank 201 includes a first chamber C1, a second chamber C2, and a third chamber C3. The third chamber C3 stores cooling water circulating along a cooling water line by a separate electric water pump (not shown).

To this end, a third cooling water inlet 211*b* in which the cooling water flows is provided at a position of the third chamber C3 in the tank body 210 of the integrated reservoir tank 201, and a separate cooling water outlet 211*c* through which the cooling water is discharged is also provided. The cooling water stored in the third chamber C3 of the integrated reservoir tank 201 circulates along a separate cooling water line by the separate electric water pump.

A third cooling target component is disposed on the separate cooling water line. When the electric water pump is driven, the cooling water in the third chamber C3 of the integrated reservoir tank 201 circulates along the cooling water line to cool the third cooling target component. Here, the third cooling target component may be a battery.

In the previous description of the embodiment of FIGS. 2 to 8, it has been described that the inner space of the integrated reservoir tank 201 is divided into the first chamber C1 and the second chamber C2 by the partition wall 213, and the cooling water circulating in the first cooling circuit 110 is stored in the first chamber C1. In addition, it has been described that the cooling water of the second cooling circuit 120 is stored in the second chamber C2.

When the reservoir tank assembly according to the embodiment of FIGS. 16 and 17 is applied to a parallel-type cooling system for cooling the first cooling target part and the second cooling target part, it may be understood that, in parallel cooling circuits of the cooling system, a cooling circuit for cooling the first component to be cooled is a first cooling circuit, and a cooling circuit for cooling the second component to be cooled is a second cooling circuit. In addition, a cooling circuit in which the cooling water of the third chamber circulates, that is, the cooling circuit for cooling the third cooling target component, may be understood as a third cooling circuit.

In accordance with the integrated reservoir tank assembly for the vehicle according to the present disclosure, there is an effect capable of reducing the number of parts, achieving reduction in production cost and weight, easily securing an installation space, easily achieving an arrangement, and solving a problem of a disadvantageous layout of a space in the vehicle and a problem of degradation in productivity. In addition, not only the number of assembly parts can be reduced, but also the number of injections of cooling water can be reduced so that there is an effect in that in-line assembly man-hours can be reduced, assemblability can be improved, and a production cost can be reduced.

Although the embodiments of the present disclosure have been described in detail, the scope of the prevent disclosure is not limited to these embodiments, and various modifications and improvements devised by those skilled in the art using the fundamental concept of the present disclosure, which is defined by the appended claims, further fall within the scope of the present disclosure.

What is claimed is:

1. An integrated reservoir tank assembly for a vehicle, comprising:

an integrated reservoir tank in which an inner space is partitioned into a first chamber configured to store cooling water of a first cooling circuit and a second chamber configured to store cooling water of a second cooling circuit by a partition wall;

a first electric water pump integrally coupled directly to the first chamber of the integrated reservoir tank and configured to transmit the cooling water stored in the first chamber along a cooling water line of the first cooling circuit; and a second electric water pump integrally coupled directly to the second chamber of the integrated reservoir tank and configured to transmit the cooling water stored in the second chamber along a cooling water line of the second cooling circuit.

2. The integrated reservoir tank assembly of claim 1, wherein:

the first cooling circuit is a cooling circuit configured to circulate the cooling water along a cooling water line connected between a motor configured to drive the vehicle and a first radiator by the first electric water pump, thereby cooling the motor; and the second cooling circuit is a cooling circuit configured to circulate the cooling water along a cooling water line connected between a battery configured to supply power to the motor and a second radiator by the second electric water pump, thereby cooling the battery.

3. The integrated reservoir tank assembly of claim 1, wherein the integrated reservoir tank includes:

a tank main body which includes the first chamber and the second chamber and of which an upper portion is open; and a cover assembled to seal the upper portion of the tank main body.

4. The integrated reservoir tank assembly of claim 3, wherein the tank main body includes:

a first pump insertion part which is formed in the first chamber side and into which a suction part of the first electric water pump, to which the cooling water stored in the first chamber is suctioned, is inserted; and a second pump insertion part which is formed in the second chamber side and into which a suction part of the second electric water pump, to which the cooling water stored in the second chamber is suctioned, is inserted.

5. The integrated reservoir tank assembly of claim 4, wherein:

a ring groove is formed on an outer circumferential surface of the suction part in a circumferential direction in at least one electric water pump of the first electric water pump and the second electric water pump; and in a state of being inserted into the ring groove in the circumferential direction, a first O-ring is press interposed between an outer circumferential surface of the suction part of the at least one electric water pump and an inner circumferential surface of the pump insertion part of the tank main body, thereby achieving fluid sealing.

6. The integrated reservoir tank assembly of claim 4, wherein:

a circular-shaped ring groove is formed on a surface in contact with an outer surface of the tank main body along a periphery of the suction part in the at least one electric water pump of the first electric water pump and the second electric water pump; and in a state of being inserted into the circular-shaped ring groove, a second O-ring is press interposed between a surface of the at least one electric water pump and the outer surface of the tank main body, thereby achieving fluid sealing.

7. The integrated reservoir tank assembly of claim 6, wherein:

the second O-ring is formed to have a flat cross-sectional shape of a predetermined thickness and a predetermined width; and protrusions in contact with an inner surface of the circular-shaped ring groove are formed to be disposed on inner and outer circumferential surfaces of the second O-ring at predetermined intervals in the circumferential direction in a state in which the second O-ring is inserted into the circular-shaped ring groove.

8. The integrated reservoir tank assembly of claim 3, wherein the partition wall includes:

a cylindrical upper partition wall formed to extend downward from an inner surface of an upper portion of the cover;

a cylindrical lower partition wall formed to extend upward from a bottom of the tank main body;

an inner partition wall formed to partition an inner space of the lower partition wall into a first chamber-side space and a second chamber-side space; and an outer partition wall installed between an outer surface of the lower partition wall and an inner surface of the tank main body and configured to partition an inner space of the tank main body into the first chamber and the second chamber in the outside of the lower partition wall.

9. The integrated reservoir tank assembly of claim 8, wherein a lower end surface of the upper partition wall and an upper end surface of the lower partition wall are coupled in a state of being bonded to form a cylindrical-shaped partition wall structure in which the upper partition wall and the lower partition wall generally have an inner space.

10. The integrated reservoir tank assembly of claim 9, wherein:

the cover is provided with a cooling water inlet configured to inject the cooling water, and a cap configured to open or close the cooling water inlet; and the cooling water inlet is formed to be disposed at an inner position of the upper partition wall in the cover.

11. The integrated reservoir tank assembly of claim 10, wherein the lower partition wall includes:

a passage hole configured to fluidly communicate between the first chamber-side space in the lower partition wall and the first chamber outside the lower partition wall, thereby allowing the cooling water to move therebetween; and a passage hole formed to pass through the lower partition wall and configured to fluidly communicate between the second chamber-side space in the lower partition wall and the second chamber outside the lower partition wall, thereby allowing the cooling water to move therebetween.

12. The integrated reservoir tank assembly of claim 1, wherein:

baffles, which are horizontally disposed at a predetermined height in a state of being supported on a support formed in each of the first chamber and the second chamber, are installed at positions above the first chamber and the second chamber in the integrated reservoir tank; and through-holes through which the cooling water passes are formed to pass through each of the baffles.

13. The integrated reservoir tank assembly of claim 12, wherein:

a plurality of fitting grooves are formed to be disposed at predetermined intervals along an edge of the baffle installed in each of the first chamber and the second chamber; and a plurality of fitting protrusions are formed to be inserted into the fitting grooves of the baffle on an inner surface of the first chamber and an inner surface of the second chamber in the integrated reservoir tank.

14. The integrated reservoir tank assembly of claim 1, further comprising:

a three-way valve integrally coupled to the first chamber of the integrated reservoir tank, wherein the three-way valve includes:

an inlet port to which a cooling water line of a cooling water outlet of the first radiator is connected;

an inlet port to which a bypass line, which is connected between a cooling water line of a cooling water inlet of the first radiator and the cooling water line of the cooling water outlet, is connected; and an exit port coupled to the first chamber of the integrated reservoir tank.

15. The integrated reservoir tank assembly of claim 14, wherein:

a valve connector, which the exit port of the three-way valve is inserted into and coupled to, is formed in the integrated reservoir tank;

a ring groove is formed on an outer circumferential surface of the exit port of the three-way valve in the circumferential direction; and in a state of being inserted into the ring groove of the exit port, the seal ring is press interposed between the outer circumferential surface of the exit port of the three-way valve and an inner circumferential surface of the valve connector of the integrated reservoir tank, thereby achieving fluid sealing.

16. The integrated reservoir tank assembly of claim 15, wherein the valve connector includes:

a port insertion part which is a portion into which the exit port of the three-way valve is inserted; and a guide passage formed to extend downward from an end portion of the port insertion part and configured to allow the cooling water discharged from the exit port of the three-way valve to flow to the first chamber.

17. The integrated reservoir tank assembly of claim 16, wherein:

the valve connector is formed in a portion located above the first chamber in the integrated reservoir tank;

the baffle, which is horizontally disposed at a predetermined height in a state of being supported on the support formed in the first chamber, is installed at an upper position of the first chamber; and through-holes through which the cooling water passes, and a guide through-hole through which the downwardly extended guide passage is inserted to pass through the guide through-hole are formed in the baffle.

18. The integrated reservoir tank assembly of claim 1, wherein:

engagement parts are formed to allow bolts to pass therethrough in the first electric water pump and the second electric water pump in a state of being bonded to an outer surface of the integrated reservoir tank;

a nut is installed at a position at which the bolt is engaged on an outer surface of the integrated reservoir tank in a state of being inserted; and the bolt coupled to pass through the engagement part is engaged with the nut so that the first electric water pump and the second electric water pump are fixed to the integrated reservoir tank.

19. The reservoir tank assembly of claim 1, wherein:

a pump housing of the first electric water pump includes a manifold in which the cooling water suctioned from the first chamber passes by the first electric water pump and then is discharged;

the manifold has two discharge parts through which the cooling water suctioned from the first chamber is discharged;

a branch pipe is connected between a first discharge part of the two discharge parts and the second chamber of the integrated reservoir tank, and thus a portion of the cooling water suctioned by the first electric water pump from the first chamber is distributed in the manifold and then flows into the second chamber through the branch pipe.

20. The reservoir tank assembly of claim 19, wherein:

a cooling water line of the first cooling circuit configured to cool a first cooling target component is connected to a second discharge part of the two discharge parts in the first electric water pump;

a cooling water line of the second cooling circuit configured to cool a second cooling target component is connected to a discharge part of the second electric water pump.

21. An integrated reservoir tank assembly for a vehicle, comprising:

an integrated reservoir tank in which an inner space is partitioned into a first chamber configured to store cooling water of a first cooling circuit and a second chamber configured to store cooling water of a second cooling circuit by a partition wall;

a first electric water pump integrally coupled to the first chamber of the integrated reservoir tank and configured to transmit the cooling water stored in the first chamber along a cooling water line of the first cooling circuit; and a second electric water pump integrally coupled to the second chamber of the integrated reservoir tank and configured to transmit the cooling water stored in the second chamber along a cooling water line of the second cooling circuit;

wherein the integrated reservoir tank includes a tank main body which includes the first chamber and the second chamber and of which an upper portion is open; and wherein the tank main body includes:

a first pump insertion part which is formed in the first chamber side and into which a suction part of the first electric water pump, to which the cooling water stored in the first chamber is suctioned, is inserted; and a second pump insertion part which is formed in the second chamber side and into which a suction part of the second electric water pump, to which the cooling water stored in the second chamber is suctioned, is inserted.

* * * * *